United States Patent [19]

Shimizu

[11] Patent Number: 4,687,971

[45] Date of Patent: Aug. 18, 1987

[54] POWER SUPPLY FOR DISCHARGE LAMP

[75] Inventor: Norimitsu Shimizu, Ebina, Japan

[73] Assignee: Fuji Xerox Company, Limited, Tokyo, Japan

[21] Appl. No.: 794,514

[22] Filed: Nov. 4, 1985

[30] Foreign Application Priority Data

| | | | |
|---|---|---|---|
| Nov. 8, 1984 | [JP] | Japan | 59-235846 |
| Mar. 18, 1985 | [JP] | Japan | 60-37501[U] |
| Apr. 5, 1985 | [JP] | Japan | 60-71032 |
| May 10, 1985 | [JP] | Japan | 60-99271 |
| May 10, 1985 | [JP] | Japan | 60-99272 |

[51] Int. Cl.[4] ..... H05B 37/00

[52] U.S. Cl. ..... 315/244; 315/214 R; 315/242; 323/222; 363/60; 430/33; 430/35

[58] Field of Search ..... 315/242, 244, 241 R; 323/222; 363/59, 60, 61; 430/33, 35

[56] References Cited

U.S. PATENT DOCUMENTS

| | | | |
|---|---|---|---|
| 1,448,583 | 3/1923 | Van der Bijl | 363/59 |
| 2,213,199 | 9/1940 | Bouwers et al. | 363/59 |
| 2,628,331 | 2/1953 | Rockafellow | 315/241 P |
| 3,523,239 | 8/1970 | Heard | 323/222 |
| 3,526,821 | 9/1970 | Thomas | 315/214 R |
| 3,697,805 | 10/1972 | Switsen | 315/183 |
| 3,735,238 | 5/1973 | Miller | 363/61 |
| 3,944,877 | 3/1976 | Sato | 315/241 R |
| 4,071,808 | 1/1978 | Zentmyer | 315/241 R |
| 4,130,670 | 12/1978 | Gilliams et al. | 430/33 |
| 4,486,691 | 12/1984 | Beggs | 315/241 P |
| 4,598,349 | 7/1986 | Lohn | 323/222 |

FOREIGN PATENT DOCUMENTS

| | | |
|---|---|---|
| 1363085 | 8/1974 | United Kingdom . |
| 1543611 | 4/1979 | United Kingdom . |
| 1572393 | 7/1980 | United Kingdom . |
| 2060286 | 4/1981 | United Kingdom . |
| 2050084 | 2/1984 | United Kingdom . |
| 2138647 | 10/1984 | United Kingdom . |

*Primary Examiner*—Harold Dixon

*Attorney, Agent, or Firm*—Bachman & LaPointe

[57] ABSTRACT

A power supply circuit comprises a single discharge capacitor having a charging sufficient to trigger discharge in a discharge lamp. The discharge capacitor is associated with means for accumulating energy, with which it is charged. The energy accumulating means receives commercially available alternating current and applies the accumulated energy to the discharge capacitor to charge the latter. The power supply circuit may include an auxiliary capacitor which has a smaller capacitance and higher potential rating than the discharge capacitor. The auxiliary capacitor may have a potential rating sufficient to activate the discharge lamp alone. The discharge capacitor cooperates with the auxiliary capacitor to define discharge period. Preferably, the power supply circuit may include means for blocking or shutting off power supply at a given timing to precisely control the discharge period. Such power supply blocking means is especially advantageous for controlling the quantity of light to be emitted by the discharge lamp. The discharge capacitor and the auxiliary capacitor are controlled so as to perform a two-stage flash which includes a first stage with a brief, relatively strong flash and a second stage with a longer, relatively weak flash. This flash is advantageous for fixing toner images with low- and high-toner-density components. Alternatively, the discharge period may be controlled to within a given period to achieve good fixation of the toner image without causing significant noise or smell.

27 Claims, 32 Drawing Figures

POWER SUPPLY FOR DISCHARGE LAMP

BACKGROUND OF THE INVENTION

The present invention relates generally to a charge/-discharge circuit for a discharge lamp which is particularly suitable for use in dry-type copiers. printers, facsimile machines and so forth as a fixation device and/or exposure device. More specifically, the invention relates to a power supply for the discharge lamp, which has improved charge/discharge characteristics for activating the discharge lamp.

Discharge lamps used in dry-type copier, printer, facsimile and so forth must have good charge characteristics. Conventionally, control of the charge characteristics of a discharge capacitor is hampered by the high voltage needed to trigger the discharge lamp to discharge energy therethrough.

At the same time, in order to improve fixation characteristics or exposure characteristics, it has been considered essential to control the discharge characteristics of the discharge lamp. In particular, control of the discharge period is very important to obtain the desired discharge energy for the required function.

Conventional charge/discharge circuits for discharge lamps have not been at all satisfactory with regard to precise control of the charge characteristics and/or discharge characteristics. In particular, when discharge lamps are employed for fixation of toner images in dry-type copiers and so forth, precise control of the charge and/or discharge period becomes essential to fixation quality.

SUMMARY OF THE INVENTION

Therefore, it is a principle object of the invention to provide a power supply circuit for a discharge lamp, the charge characteristics and/or discharge characteristics of which can be controlled in an improved manner.

Another and more specific object of the invention is to provide a power supply circuit for a discharge lamp, which can activate a discharge lamp by means of a discharge capacitor and which requires a relatively low voltage for charging the discharge capacitor within a period comparable or shorter than the charge period of conventional circuits.

A further object of the invention is to provide a power supply circuit for a discharge lamp which allows the discharge period to be set freely without degrading the activation characteristics of the discharge lamp.

A still further object of the invention is to provide a power supply circuit for a discharge lamp which enables precise control of the discharge period of the discharge lamp.

A yet further object of the invention is to provide a power supply circuit which is specifically adapted for use as a power supply for a discharge lamp in a fixation device for fixing a toner image, which power supply is controlled so as to improve fixation characteristics in order to obtain a high-quality of fixed toner image.

In order to acomplish the aforementioned and other objects, a power supply circuit, according to the present invention, comprises a single discharge capacitor having a charging sufficient to trigger discharge in a discharge lamp. The discharge capacitor is associated with means for accumulating energy, with which it is charged. The energy accumulating means receives commercially available alternating current and applies the accumulated energy to the discharge capacitor to charge the latter.

The power supply circuit may include an auxiliary capacitor which has a smaller capacitance and higher potential rating than the discharge capacitor. The auxiliary capacitor may have a potential rating sufficient to activate the discharge lamp alone. The discharge capacitor cooperates with the auxiliary capacitor to define discharge period.

Preferably, the power supply circuit may include means for blocking or shutting off power supply at a given timing to precisely control the discharge period. Such power supply blocking means is especially advantageous for controlling the quantity of light to be emitted by the discharge lamp.

In accordance with another feature of the invention, the discharge capacitor and the auxiliary capacitor are controlled so as to perform a two-stage flash which includes a first stage with a brief, relatively strong flash and a second stage with a longer, relatively weak flash. This flash is advantageous for fixing toner images with low- and high-toner-density components.

Alternatively, the discharge period may be controlled to within a given period to achieve good fixation of the toner image without causing significant noise or smell.

In accordance with one aspect of the invention, a power supply circuit for a discharge lamp comprises a primary charge current supply means for accumulating energy, a single primary discharge capacitor associated with the charge current supply means to receive the accumulated energy at a given timing to be charged, the discharge capacitor supplying power to the discharge lamp to cause emission of light upon discharging, and a trigger means, associated with the discharge lamp, for triggerng energization of the discharge lamp and discharge of the discharge capacitor and thereby causing emission of light by the discharge lamp.

The primary charge current supply means includes an alternating current source, accumulates energy while the alternating current is a first phase and supplies the accumulated energy to the primary discharge capacitor while the alternating current is a second, opposite phase. The charge current supply means includes a switching means responsive to zero-crossing of the alternating current to control accumulation and supply of energy.

The power supply circuit is associated with a secondary circuit including a secondary charge current supply means for accumulating energy and a secondary discharge capacitor connected in series to the primary discharge capacitor, the secondary discharge capacitor being associated with the secondary charge current supply means to be charged at a given timing with the energy accumulated by the secondary charge current supply means. The secondary charge current supply means includes an alternating current source, accumulates energy while the alternating current is a first phase and supplies the accumulated energy to the secondary discharge capacitor while the alternating current is a second, opposite phase.

The power supply circuit further comprises a second auxiliary capacitor of lower capacitance than the first primary capacitor, the second auxiliary capacitor being associated with the charge current supply means to be commonly charged with the first primary capacitor, and the potential of the second auxiliary capacitor being sufficiently high to energize the discharge lamp. The first primary and second auxiliary capacitor are charged by the charge current supply mean at different voltages. The charge current supply means comprises a flyback transformer.

The charge current supply means comprises a first component associated with the first primary capacitor for charging the latter and a second component associated with the second auxiliary capacitor for charging the latter, and the first and second components of the charge current supply means operating independently of each other.

Each of the first and second components comprises a flyback transformer.

The power supply circuit further comprises means for blocking power supply to the discharge lamp, the blocking means becoming active at a given timing. The blocking means is responsive to a timing signal generated when the time integral of the light flux emitted by the discharge lamp reaches a predetermined value. The blocking means comprises a capacitor charged by part of the power supplied to the discharge lamp and which discharges in response to the timing signal.

In the alternative. the power supply circuit further comprises a second auxiliary capacitor having a lower capacitance and a higher charge voltage than the first primary capacitance, the first primary and second auxiliary capacitors being discharged at different known times. The second auxiliary capacitor discharges prior to the first primary capacitor, thereby inducing brief, intense light emission by the discharge lamp, and subsequently inducing a weaker, longer emission by means of discharging the first primary capacitor.

The first primary capacitor discharges prior to the second auxiliary capacitor, thereby inducing a weak, prolonged light emission by the discharge lamp and subsequently inducing an intense, brief emission by means of discharging the second auxiliary capacitor.

The discharge period of the discharge lamp is in the range of 3 msec. to 9 msec.

In accordance with another aspect of the invention, a charge/discharge circuit for a discharge lamp comprises a charge current supply means supplying current at a known voltage for capacitor charging, a primary discharge capacitor associated with the charge current supply means to receive the current at a given timing and connected to the discharge lamp to supply power thereto so as to energize light emission thereby, a secondary discharge capacitor associated with the current supply means to receive current at a given timing and connected to the discharge lamp to supply power thereto, the secondary discharge capacitor having a lower capacitance and a higher potential than the primary discharge capacitor, which potential being sufficiently high to energize the discharge lamp, and a trigger means, associated with the discharge lamp, for triggering the discharge lamp and triggering discharge of the discharge capacitor and thereby triggering light emission by the discharge lamp.

The first primary and second auxiliary capacitors are charged by the current supply means at different voltages.

The current supply means comprises a flyback transformer.

In the alternative, the current supply means comprises a first component associated with the first primary capacitor for charging the latter and a second component associated with the second auxiliary capacitor for charging the latter, and the first and second components of the current supply means operating independently of each other. Each of the first and second components comprises a flyback transformer.

In accordance with a further aspect of the invention, a process for performing fixation of a toner image by means of discharge lamp comprising the steps of:

charging a capacitor means connected in series with the discharge lamp;

applying a trigger to the discharge lamp to cause discharge of the capacitor means and activation of the discharge lamp; and discharging the capacitor means through the discharge lamp within a given period comprising a first period wherein a first predetermined quantity of light is emitted and a second period wherein a second predetermined quantity of light is emitted, the first and second periods coverng different lengths of time being and the first and second quantities of light different, and the second period following the first period.

The first period is relatively short and the first quantity of light is relatively large, and the second period is much longer than the first period and, the second quantity of light is much smaller than the first quantity of light. The first period is much longer than the second period and the first quantity of light is much smaller than the second.

The process further comprises a step of charging a first and a second capacitor in the capacitor means, which first capacitor has a larger capacitance and a longer discharge period than the second capacitor and a lower discharge voltage than the second capacitor, and the second capacitor discharges during the first period and the first capacitor discharges during the second period.

An alternative process comprises a step of charging a first and a second capacitor in the capacitor means, which first capacitor has a larger capacitance and a longer discharge period than the second capacitor and a lower discharge voltage than the second capacitor, and the second capacitor discharges during the first period and the first capacitor discharges during the second period.

The first and second capacitors are connected in series.

In accordance with a still further aspect of the invention, a process for performing fixation of a toner image by means of discharge lamp comprising the steps of:

charging a capacitor means connected in series with the discharge lamp;

applying a trigger to the discharge lamp to cause discharge of the capacitor means and activation of the discharge lamp; and discharging energy through the discharge lamp over a period of from 3 msec. to 9 msec.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiments but are for explanation and understanding only.

In the drawings.

DESCRIPTION OF THE PREFERRED EMBODIMENT

Figure 1:
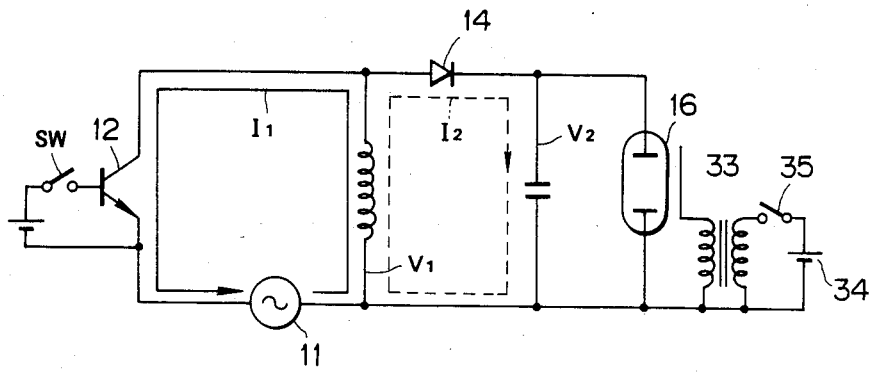
FIG. 1 is a schematic circuit diagram of the first embodiment of a power supply circuit for a discharge lamp according to the present invention.

Referring now to the drawings, particularly to FIG. 1, a commercially available alternating current source 11 is connected to a coil 13 which has an inductance L. The collector-emitter path of an NPN transistor 12 is connected in a loop with the alternating current source 11 and the coil 13. A switch SW is connected to the base of the switching transistor 12 to turn the latter ON and OFF. As the transistor 12 is turned ON and OFF, the loop circuit is closed and opened respectively.

A capacitor 14 is connected in parallel to the coil 13. A diode 14 is connected between the coil 13 and the capacitor 15, with its anode electrode connected to the inductance coil and its cathode electrode connected to the capacitor 15.

A discharge lamp 16 is also connected in parallel to the capacitor 15 and associated with a trigger circuit which comprises a trigger coil 33, a trigger power source 34 and a trigger switch 35.

Figure 2:
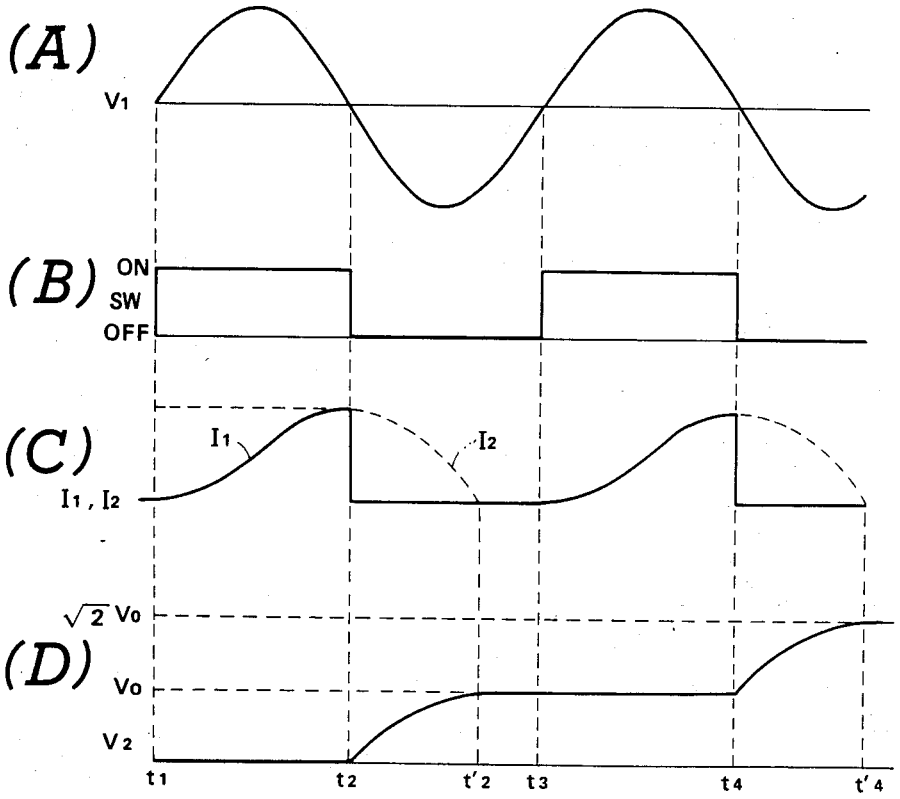
FIG. 2 is a timing chart illustrating the charge and discharge operations of the power supply circuit of FIG. 1.

In this circuit, when the switch SW is closed in the positive phase period, i.e. during the period $t_1$ to $t_2$ of FIG. 2, the loop current $I_1$ illustrated in solid lines is generated. The waveform of the current flowing through the coil 13 during this period is shown in FIG. 2(C). The instantaneous electrical energy represented by the expression $$\tfrac{1}{2}L\,I_1^2$$

thus appears at the inductance coil 13.

Then, the switch SW is opened again during negative phase period, e.g. during the period $t_2$ to $t_3$, so that the current $I_1$ flowing through the aforementioned loop drops to zero, resulting in a reverse electromotive force. As a result, a flyback current $I_2$, as illustrated in broken lines in FIGS. 1 and 2 flows through the coil 13, the diode 14, the capacitor 15 and as shown in FIG. 2(C). The flyback current $I_2$ drops to zero at a time $t_2'$. At this time, the charge voltage across the capacitor 15 is maximized as shown in FIG. 2(D).

In other words, at time $t_2'$ at which the flyback current $I_2$ drops to zero, the electrical energy in the coil 13 represented by the expression . . .

$$\tfrac{1}{2}L\,I_0^2$$

wherein $I_0$ represents the flyback current at the time $t_2$, is transferred to the capacitor 15. This can be illustrated by the following equation:

$$\tfrac{1}{2}L\,I_0^2=\tfrac{1}{2}C\,V_0^2 \qquad (1)$$

wherein C is the capacitance of the capacitor 15, and $V_0$ is the voltage across the terminals at the time $t_2'$.

It should be noted that, in the discussion, loss of electrical energy due to resistance in the electrical components and lead wires of the circuit and so forth is disregarded.

At time $t_3$, the switch SW is again closed. The current $I_1$ again flows through the coil 13. As described above, electrical energy in the coil 13 is transferred to the capacitor 15 during the period $t_4$ to $t_4'$ after the switch SW is opened again. Therefore, the electrical energy accumulated in the capacitor is doubled. Similarly, the voltage across the terminals of the capacitor 15 at time $t_4'$ becomes $\sqrt{2}$ times as great as the voltage $V_0$ at the time $t_2'$.

By repeating above operation over several cycles, at a time $t_{2n}$, the voltage between the terminals of the capacitor 15 becomes $\sqrt{n}$ times greater than the voltage $V_0$ at the time $t_2'$. When the capacitor voltage $|V_0$ reaches a predetermined level, a high voltage is applied to a trigger electrode opposite the discharge lamp by the trigger coil 33.

According to the shown embodiment, since a single capacitor is intermittently charged instead of a plurality of mutually parallel capacitors, excessive input rush current can be successfully prevented, which prevents damage to the diode and/or leads due to overheating. In addition, according to the shown embodiment, the accumulated energy in the capacitor 15 can be held constant, so that secular variation of the characteristics of the capacitor, especially reduction of the capacitance of the capacitor, will not affect the discharge potential of the capacitor. For instance, if the capacitance C of the capacitor 15 should decrease due to secular variation, the voltage $\sqrt{n}V_0$ would increase to compensate for the reduction of the capacitance. Therefore, there will be no drop in the discharge energy which might affect the operating potential of the discharge lamp 16.

Figure 3:
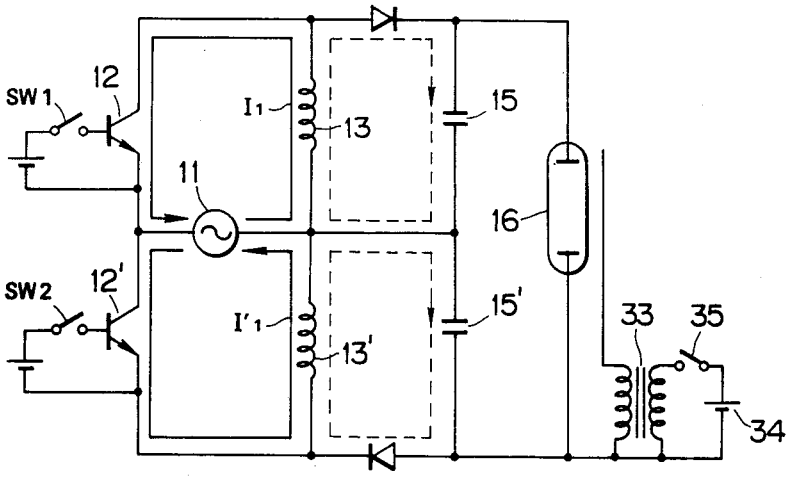
FIG. 3 is a schematic circuit diagram of a modification to the first embodiment of the power supply circuit of FIG. 1.
Figure 4:
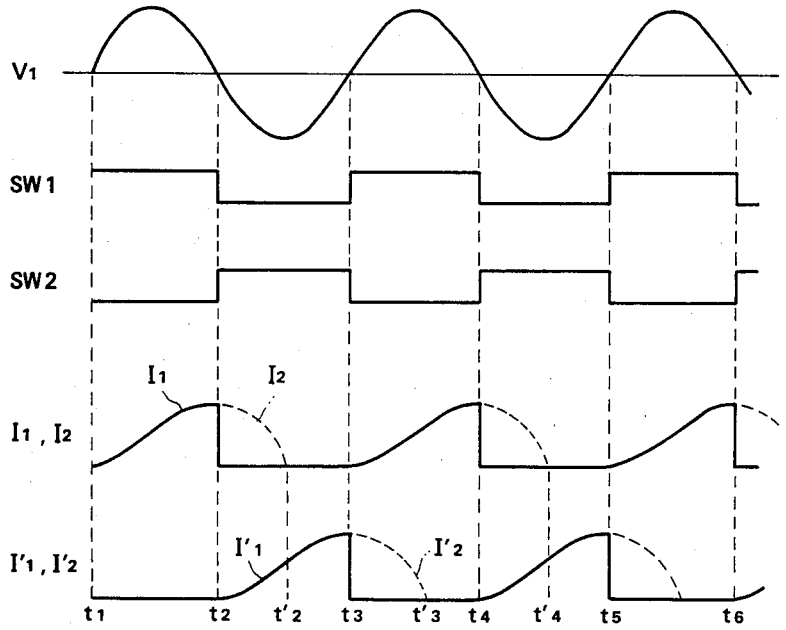
FIG. 4 is a timing chart illustrating the charge and discharge operations of the power supply circuit of FIG. 3.

FIGS. 3 and 4 show a modification to the first embodiment of the power supply for the discharge lamp according to the present invention. This embodiment is designed to charge the capacitor in both half-cycles of the alternating current and thus to improve the charging efficiency of the capacitor. For this purpose, an additional coil 13', an additional switching transistor 12' and an additional capacitor 15' are provided. The capacitor 15' is connected in series to the capacitor 15.

As will be appreciated from FIGS. 3 and 4, this embodiment employs switches $SW_1$ and $SW_2$ to turn the switching transistors 12 and 12' ON and OFF. The switch $SW_1$ closes when the voltage of the alternating current increases across the zero-volt level and remains closed while the voltage $V_1$ remains positive. On the other hand, the switch $SW_2$ is designed to close when the voltage $V_1$ of the alternating current drop below zero volts and remains closed while the voltage $V_1$ remains negative. The closure timing of the switch $SW_1$ is substantially the same as that of the switch SW in the first embodiment of FIGS. 1 and 2.

Therefore, the charge operation and timing of the capacitor 15 is substantially same as that discussed with respect to FIGS. 1 and 2. Specifically, the capacitor 15 is charged at times $t_2'$, $t_4'$. . . . $t_{2n}'$. At the time $t_{2n}'$, the charge voltage on the capacitor 15 will be $\sqrt{n}V_0$, as set forth above.

On the other hand, as shown in FIG. 4, the switch $SW_2$ is closed at the time $t_2$, at which the voltage $V_1$ drops below zero volts. Closing the switch $SW_2$ renders, the transistor 12' conductive and so closes the circuit loop of the coil 13' and the transistor 12'. Therefore, a current $I_1'$ flows through the coil 13. If the inductance of the coil 13' is same as that of the coil 13, the energy in the coil 13' will generally be equal to that in the coil over the period $t_1$ to $t_2$.

The switch $SW_2$ is open while the voltage $V_1$ is positive. When the switch $SW_2$ opens, the transistors 12' turns OFF and so breaks the loop. As a result, a reverse electromotive force is induced in the coil 13', represented by the flyback current $I_2'$ flowing through the capacitor 15' and the diode 14'. Therefore, the capacitor 15' is charged to the voltage $V_0$ at the time $t_3'$. The charge level of the capacitor 15' reaches $\sqrt{n}V_0$ at a time $t_{2n}+1'$ which is one half-cycle later than the timing $t_{2n}$.

Since the capacitors 15 and 15' are connected in series as set forth above, the potential applied to the discharge lamp is $2\sqrt{n}V_0$ at time $t_{2n}+1$. Therefore, as will be naturally appreciated, the charging efficiency of the capacitors 15 and 15' is twice that of the first embodiment. In other words, in order to charge the capacitor to the necessary voltage level, this modification requires half the time of the first embodiment.

Figure 5:
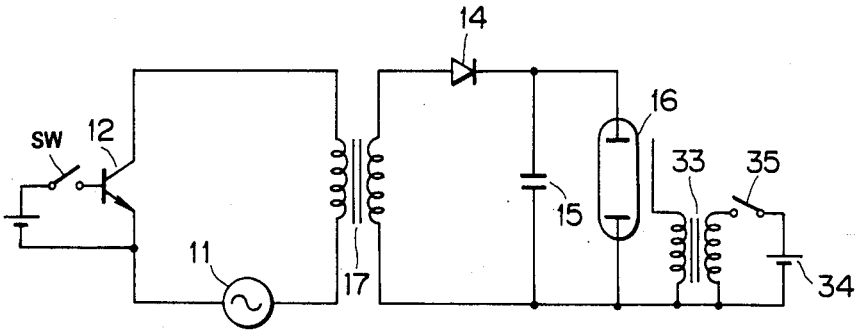
FIGS. 5 and 6 are schematic circuit diagrams of modifications to the power supply circuit of FIG. 1.
Figure 6:
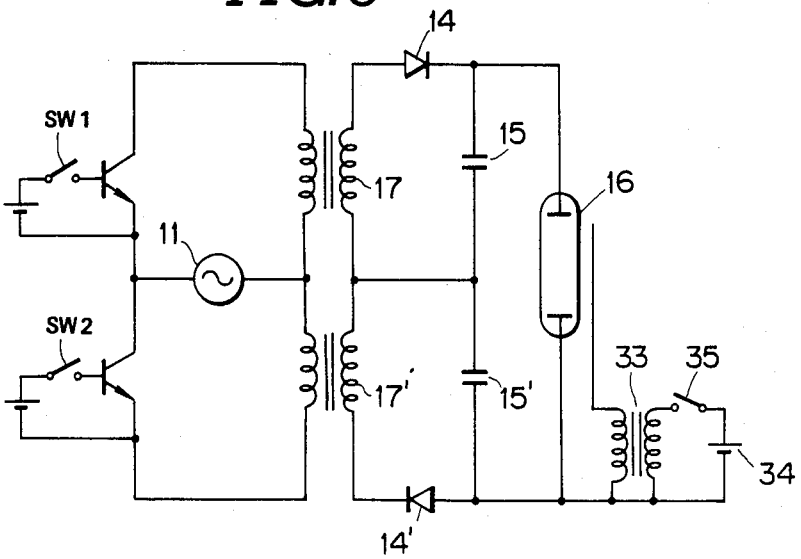

FIGS. 5 and 6 are modifications to the first embodiment. FIG. 5 is another modification of the first embodiment of FIGS. 1 and 2, and FIG. 6 is a further modification of the modifcation of FIGS. 3 and 4. In these modifications, flyback transformer or transformers 17 and 17' are employed as replacements for the coils 13 and 13'. The generation of potential in the flyback transformers 17 and 17' and transfer of the potential to the capacitors 15 and 15' are substantially the same as in the preceding embodiments.

Figure 7:
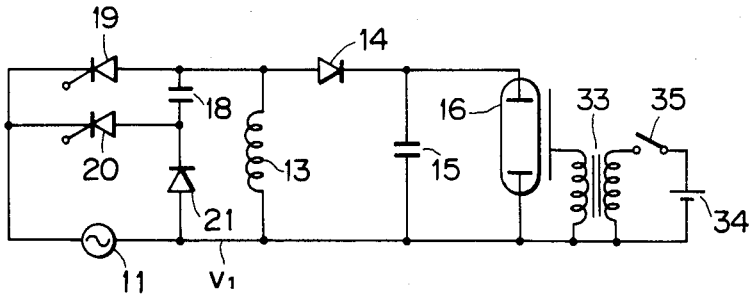
FIG. 7 is a schematic circuit diagram of the second embodiment of a power supply circuit for a discharge lamp according to the present invention.
Figure 8:
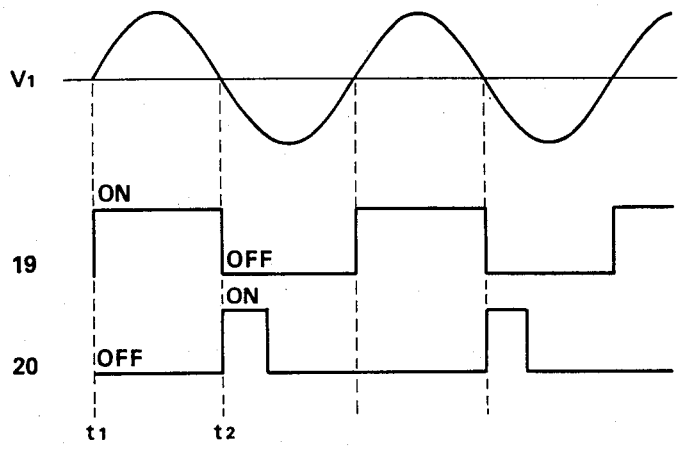
FIG. 8 is a timing chart illustrating the charge and discharge operations of the power supply circuit of FIG. 7.

FIG. 7 shows the second embodiment of the power supply for the discharge lamp according to the invention. FIG. 8 is a timing chart for the circuit of FIG. 7. In this embodiment, an auxiliary diode 21, a commutating capacitor 18, a main thyristor 19 and commutating thyristor 20. As shown in FIG. 8, the main thyristor 19 is turned ON in response to increase of the voltage $V_1$ of the alternating current from the commerical power source 11 across OV, and remains ON while the voltage $V_1$ remains positive. On the other hand, the commutating thyristor 20 is turned ON in response to negative-going zero-crossing of the voltage $V_1$ of the alternating current and remains ON for a given period of time.

According to the timing chart of FIG. 8, when the alternating current is supplied to the circuit set forth above, the main thyristor 19 turns ON in response to positive-going zero-crossing of the voltage $V_1$ of the alternating current, at a time $T_1$. Current thus flows from the commercial power source 11, through the coil 13 and the main thyristor and back to the commercial power source 11. The current flowing through the coil 13 generates electrical energy as set out with respect to the first embodiment. At the same time, the current also flows through the commercial power source 11, the auxiliary diode 21, the commutating capacitor 18 and the main thyristor 19. Thus, the commutating capacitor 18 is charged to the peak value of the alternating current voltage. In this case, the terminal of the commutating capacitor connected to the auxiliary diode 21 will be the cathode.

After a half-cycle following time $t_1$, i.e. at a time $_2$, the main thyristor 19 is turned OFF and the commutating thyristor 20 turns ON in response to negative-going zero-crossing of the voltage $V_1$. At this time, a reverse electromotive force is generated in the coil 13. The energy of the reverse electromotive force generated in the coil 13 is added to with the energy already stored in the commutating capacitor 18. The current flows from the commercial power source 11, through the coil 13, the commutating capacitor 18 and the commutating thyristor 20 and back to the commercial power source 11. At this time, the current flowing through the main thyristor 19 remains below a holding current of the main thyristor. Therefore, the main thyristor remains OFF.

At the same time, the current flows through the coil 13, the diode 14, and the capacitor 15 and returns to the coil 13. Therefore, the capacitor 15 is charged. The charge period is selected so that charging of the capacitor 15 is completed during the period while the voltage $V_1$ is negative. Thus, the capacitor 15 is charged to a voltage $V_2$ within one cycle of the alternating current.

As in the first embodiment, the capacitor 15 is charged repeatedly over several cycles of the alternating current until the charge on the capacitor 15 reaches $V_2$. When the charge on the capacitor 15 become equal to or greater than the required voltage, the discharge lamp 16 flashes in response to a trigger voltage from the trigger coil 33.

Figure 9:
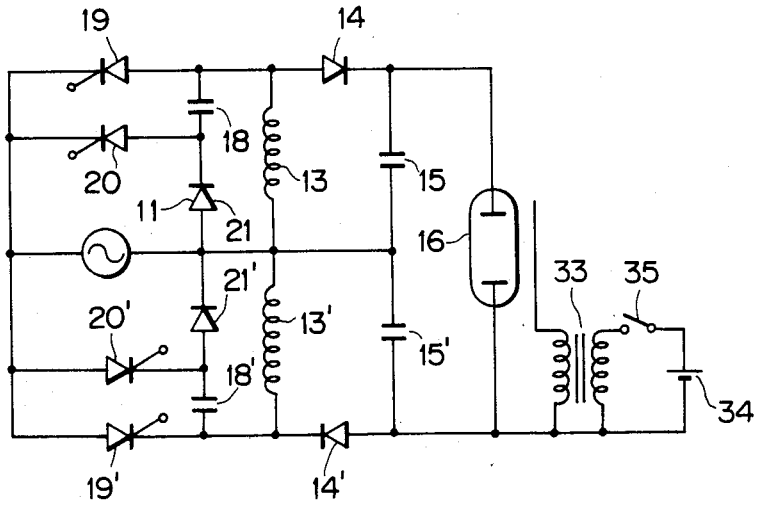
FIG. 9 is a schematic circuit diagram of a modification of the second embodiment of the power supply circuit of FIG. 7.
Figure 10:
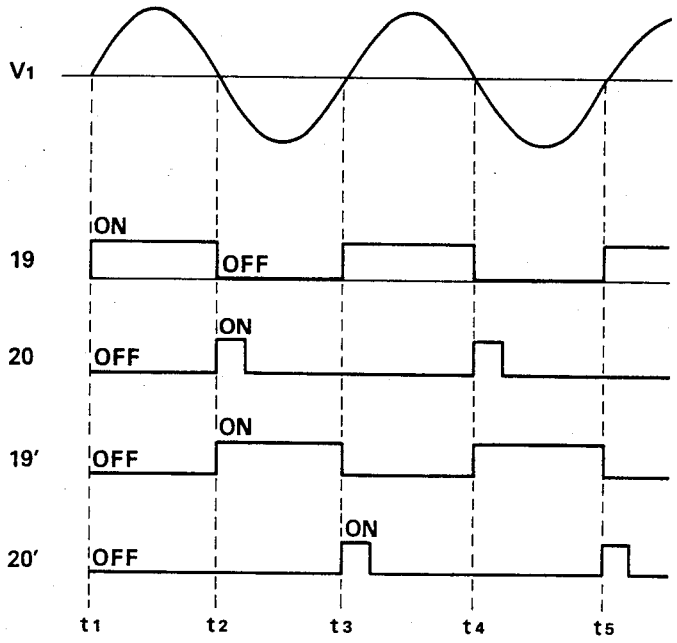
FIG. 10 is a timing chart illustrating the charge and discharge operations of the power supply circuit of FIG. 9.

FIGS. 9 and 10 show a modification the second embodiment of FIGS. 7 and 8. FIG. 9 is a schematic circuit diagram of the power circuit for a discharge lamp showing a modification to the circuit of FIG. 5, and FIG. 10 is a timing chart of operation of the circuit of FIG. 9. This modification is designed to charge the capacitors 15 and 15' at different phases of the alternating current of the commercial power source 11.

As will be appreciated from FIG. 9, the shown modification employs another set of a primary thyristor 19' and a commutating thyristor 20' in addition to the primary and commutating thyristors 19 and 20 of the embodiment of FIGS. 7 and 8. Also, an additional commutating capacitor 18' and auxiliary diode 21' are provided in the circuit. The main thyristor 19', the commutating thyristor 20', the commutating capacitor 18 and the auxiliary diode 21' are associated with another coil 13', another diode 14' and another capacitor 15' to form an auxiliary charge circuit which cooperates with a primary charge circuit consisting of the main thyristor 19, the commutating thyristor 20, the commutating capacitor 18, the auxiliary diode 21, the coil 13, the diode 14 and the capacitor 15.

As shown in FIG. 10, the main thyristor 19' is turned ON when the voltage $V_1$ of the alternating current from the commercial power source 11 drops below 0 V, and remains ON while the voltage $V_1$ remains negative. On the other hand, the commutating thyristor 20' is turned ON in response to a positive-going zero-crossing by the voltage $V_1$ of the alternating current and remains ON for a given period of time.

According to the timing chart of FIG. 10, when the alternating current is applied to the circuit described above, the circuit including the main thyristor 19, the commutating thyristor 20, the commutating capacitor 18 and the auxiliary diode 21 functions substantially the same as disclosed with respect to FIGS. 7 and 8. On the other hand, main thyristor 19' turns OFF in response to the positive-going zero-crossing of the voltage $V_1$ of the alternating current at time $t_1$.

One half-cycle after time $t_1$, i.e. at time $_2$, the main thyristor 19' is turned ON while the commutating thyristor 20' remains OFF. The main thyristor 19' allows current to flow through the coil 13' and the main thyristor and back to the commercial power source 11. The current through the coil 13' generates electrical energy as explained with respect to the first embodiment. At the same time the current also flows through the commercial power source 11, the auxiliary diode 21', the commutating capacitor 18' and the main thyristor 19'. This current charges the commutating capacitor 18' to the peak value of the alternating current voltage. The terminal of the commutating capacitor connected to the auxiliary diode 21' is the cathode. Then, at a time $t_3$ one half-cycle after the time $t_2$, the commutating thyristor 20' turns ON in response to the positive-going zero-crossing of the voltage $V_1$. At this time, the reverse electromotive force from in the coil 13' is added to the energy already stored in the commutating capacitor 18'. Current then flows from the commercial power source 11, through the coil 13', the commutating capacitor 18' and the commutating thyristor 20' and back to the commercial power source 11. At this time, the current flowing through the main thyristor 19' is held below a holding current of the main thyristor. Therefore, the main thyristor remains.

At the same time, current flows from the coil 13', through the diode 14', and the capacitor 15' and back to the coil 13', thus charging the capacitor 15'. The charge period is selected so that the capacitor 15' is fully charged within the period during which the voltage $V_1$ remains negative. Thus, the capacitor 15' is charged to a voltage $V_2$ within one cycle of the alternating current.

As will be appreciated herefrom, as in the embodiment described with respect to FIGS. 5 and 6, the potential applied to the discharge lamp will be $2\sqrt{n}V_0$ at time $t_{2n}+1$. Therefore, as will be naturally appreciated, the charging efficiency the capacitors 15 and 15' is twice as high as in the first embodiment. In other words, this modification requires half the time needed by the second embodiment to charge the capacitor at the necessary voltage level.

Figure 11:
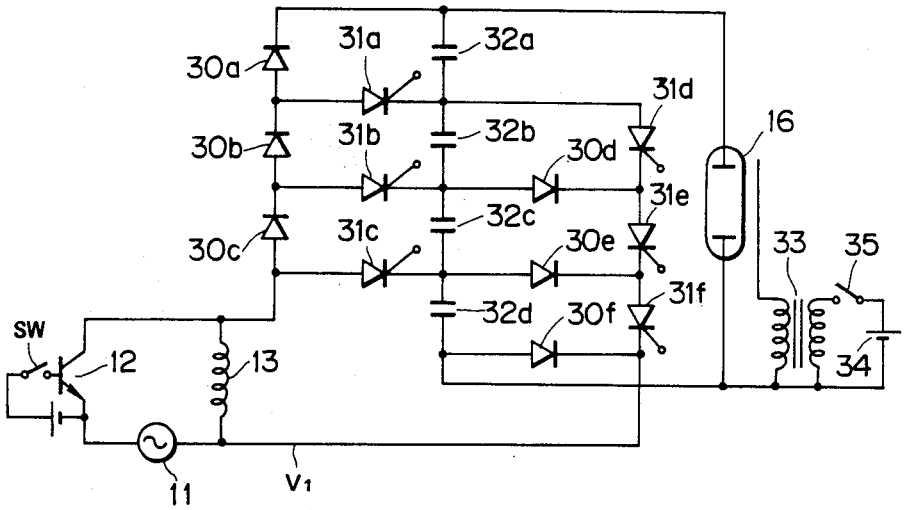
FIG. 11 is a schematic circuit diagram of the third embodiment of a power supply circuit for a discharge lamp according to the present invention.
Figure 12:
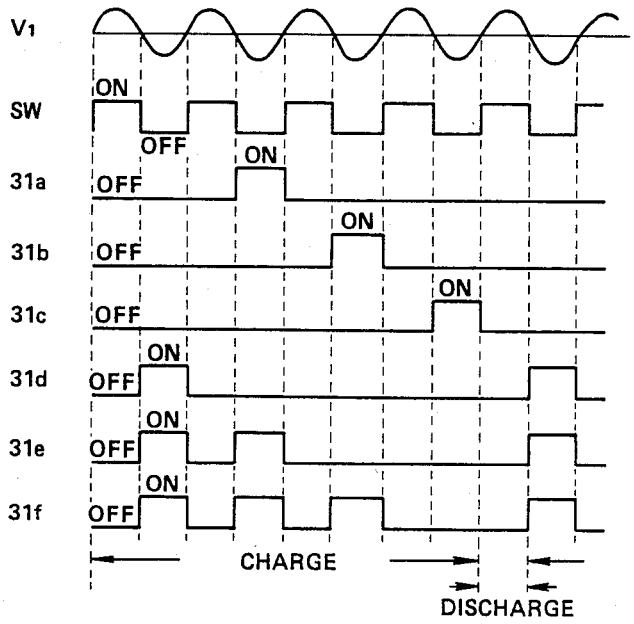
FIG. 12 is a timing chart illustrating the charge and discharge operations of the power supply circuit of FIG. 11.

FIGS. 11 and 12 show the third embodiment of the power supply for the discharge lamp according to the invention. The shown circuit includes a switch SW which opens and closes depending upon the polarity of the alternating current from the commercial power source 11, which switch functions substantially the same as described with respect to the first embodiment. The circuit is also provided with diodes $\mathbf{30}_a$ to $\mathbf{30}_f$, thyristors $\mathbf{31}_a$ to $\mathbf{31}_f$ and discharge capacitors $\mathbf{32}_a$ to $\mathbf{32}_a$.

As shown in FIG. 12, during the first half-cycle (positive phase) of the altnerating current, the switch SW is closed and thus the switching transistor 12 in ON. During this period, the current from the commercial power source 11 flows through the coil 13 and transistor 12 and then back to the commercial power source. During this period, the energy is generated in the coil 13. When the phase of the alternating current from the commercial power source 11 goes negative, the switch SW is opened and thus the transistor 12 is turned OFF. Therefore, a reverse electromotive force is generated in the coil 13. At the same time, the thyristors $\mathbf{31}_d$, $\mathbf{31}_e$ and $\mathbf{31}_f$ are turned ON. At this time, the thyristors $\mathbf{31}_a$, $\mathbf{31}_b$ and $\mathbf{31}_c$ are held OFF. As a result, current flows through the coil 13, the diodes $\mathbf{30}_c$, $\mathbf{30}_b$ and $\mathbf{30}_a$, the capacitor $\mathbf{32}_a$, and the thyristors $\mathbf{31}_d$, $\mathbf{31}_e$ and $\mathbf{31}_f$ and back to the coil 13. Therefore, the capacitors $\mathbf{32}_a$ is charged during this period.

In response to a positive-going zero-crossing of the alternating current from the commercial power source in the second cycle, the switch SW again closes to turn ON the transistor 12. As a result, electrical energy is again built up in the coil 13. In response to the negative-going zero-crossing in the second cycle, the switch SW opened and thus the transistor 12 is turned OFF. Then, the thyristors $\mathbf{31}_a$, $\mathbf{31}_e$ and $\mathbf{31}_f$ turn ON. At this time, the thyristors $\mathbf{31}_b$, $\mathbf{31}_c$ and $\mathbf{31}_d$ are held OFF. Therefore, current flows from the coil 13 through the diodes $\mathbf{30}_c$, $\mathbf{30}_b$, the thyristor $\mathbf{31}_a$, the capacitor $\mathbf{32}_b$, diode $\mathbf{30}_d$ and the thyristors $\mathbf{31}_e$ and $\mathbf{31}_f$ and back to the coil 13. Therefore, in the second cycle, the capacitor $\mathbf{32}_b$ is charged.

Likewise, the capacitors $\mathbf{32}_c$ and $\mathbf{32}_d$ are charged respectively in the third and fourth cycles of the altnerating current. The capacitors $32_a$, $32_b$, $32_c$ and $32_d$ are all discharged after all of the capacitors have been charged. Therefore, in this embodiment, discharge can take place every 4 cycles of the alternating current. This discharge involves is the total of the potentials on the four capacitors, since the four capacitors are connected in series with the discharge lamp 16.

Figure 13:
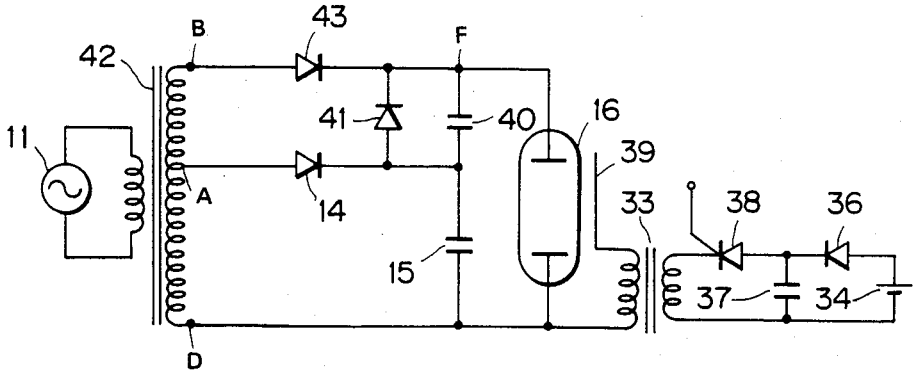
FIG. 13 is a schematic circuit diagram of the fourth embodiment of a power supply circuit for a discharge lamp according to the present invention.
Figure 14:
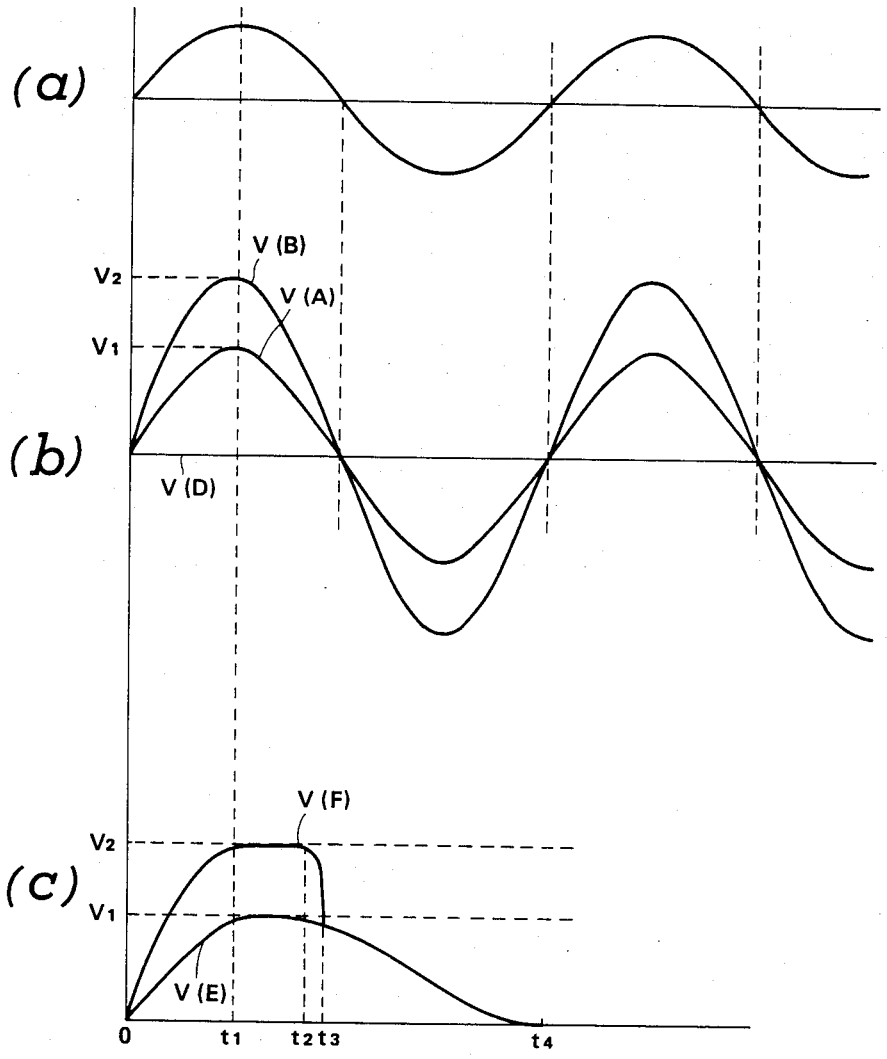
FIG. 14 is a timing chart illustrating the charge and discharge operations of the power supply circuit of FIG. 13.

FIG. 13 shows the fourth embodiment of the power supply circuit for the discharge lamp according to the invention. FIG. 14 is a timing chart of the operation of the circuit of FIG. 13. In the shown embodiment, a discharge capacitor 15 is connected in series to an auxiliary capacitor 40. A rectifier 41 is connected in parallel with the auxiliary capacitor 40. The capacitor 40 and the rectifier 41 are connected to a terminal B of a secondary winding of a step-up transformer 42 through a rectifier 43, at terminals F remote from the discharge capacitor 15. On the other hand, the terminals F are connected to the negative electrode of the discharge lamp 16.

The discharge lamp 16 is, in turn, associated with the trigger transformer 33 which is responsive to a trigger from a trigger circuit. The trigger circuit comprises a trigger power source 34, a rectifier 36, a trigger capacitor 37 and a thyristor 38. A trigger pulse is applied from an appropriate external controller at an appropriate timing to the thyristor 38. The thyristor 38 turns ON in response to the trigger pulse. In response to turning ON of the thyristor 38, the trigger capacitor 37 discharges. As a result, current flows through the thyristor 37 and the primary winding of the trigger transformer 33. Therefore, a trigger voltage for the discharge lamp 16 is induced in the secondary winding of the trigger transformer. The discharge lamp 16 is responsive to the trigger voltage to discharge.

The operation of the circuit shown in FIG. 13 will be described with reference to FIG. 14. FIG. 14(*a*) shows the waveform of the alternating current supplied by the commerical power source. The alternating current from the commercial current source 11 is stepped up by the step-up transformer 42 as shown in FIG. 14 (*b*). The stepped up current has substantially the same frequency as the current from the commercial power source. Assuming the potential VD at a point D of the secondary winding of the transformer 42 is constant, the potentials at points A and B are respectively VA and VB as shown in FIG. 14(*b*). Also, assuming the potential VD at the point D is constant, the potentials VE and VF at the points E and F vary as shown in FIG. 2(*c*).

During the period $t_0$ to $t_1$, the potentials VE and VF at the points E and F increase with the potentials VA and VB. At time $t_1$, the potential VE at the point E reaches the peak votlage $V_1$ of the potential VA at the point A. At the same time, the potential VF at the point F reaches the peak voltage $V_2$ of the potential VB at the point B.

Assuming the thyristor 37 is triggered at time $t_2$, a trigger voltage is generated at a trigger electrode 39 of the triger circuit. As a result, the discharge voltage of the discharge lamp 16 is lowered so that the discharge lamp 16 can start discharging the voltage VF at the negative electrode of the discharge lamp 16.

As is well known, once discharge starts, the discharge lamp 16 continues to discharge until the voltage at its terminal drops to zero. Therefore, the discharge lamp 16 continues discharging throughout the period $t_2$ to $t_4$. During this period, the discharge current from the capacitor 15 flows through the anxiliary capacitor 40 to the discharge lamp 16 and then back to the capacitor 15.

Since the capacitance of the auxiliary capacitor 40 is smaller than that of the discharge capacitor 15, the auxilary capacitor 40 is completely discharged earlier than the capacitor 15. For instance, in FIG. 14(*c*), the auxiliary capacitor 40 finishes discharging at a time $t_3$. After the potential on the auxiliary capacitor 40 drops to zero, the discharge current from the capacitor 15 starts to flow through the rectifier 41 and the discharge lamp 16, and then back to the capacitor 15. As mentioned previously the discharge lamp 16 continues to discharge even at relatively low voltages, so that the discharge lamp 16 continue to flash over the period $t_3$ to $t_4$.

Therefore, by properly selecting the capacitance of the capacitor 15, the discharge period of the discharge lamp 16 can be arbitrarily selected. On the other hand, the discharge period of the auxiliary capacitor 40 is independent of the capacitance of the capacitor 15. Thus, the discharge voltage of the auxiliary capacitor 40, which is added to the potential of the capacitor 15, can be large enough to allow discharge of the discharge lamp 16 when the trigger voltage is applied to the trigger electrode 39.

As mentioned previously, according to this embodiment, the capacitance of the discharge capacitor 15 can be increased without degrading the response characteristics of the discharge lamp to the trigger pulse applied to the thyristor 38. Furthermore, the charge on the discharge capacitor 16 can be adjusted by moving point A along the secondary winding of the step-up transformer 42.

If necessary, by grounding the point A of the secondary winding of the step-up transformer, the maximum voltage $V_2$ between the point F and ground can be made smaller so as to reduce the shock generated when someone contacts the circuit and thus improve safety.

Figure 15:
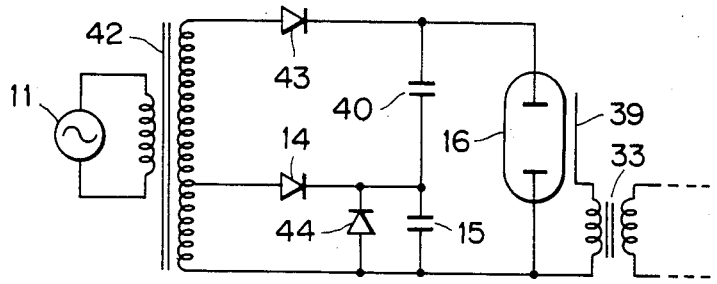
FIGS. 15, 16 and 17 are schematic circuit diagrams of modifications to the fourth embodiment of the power supply circuit of FIG. 13.

FIG. 15 shows a modification to the fourth embodiment of the power supply circuit for the discharge lamp according to the invention. In this modification, the discharge capacitor 15 is connected to the point B of the secondary winding of the step-up transformer 42 and the auxiliary capacitor 40 is connected to the point A of the secondary winding. This arrangement produces results equivalent of comparable to those of the fourth embodiment.

While the embodiments of FIGS. 13 to 15 employ a common step-up transformer for charging both the discharge capacitor 15 and the auxiliary capacitor 40, it would be possible to charge the capacitors by separate step-up transformers.

Figure 16:
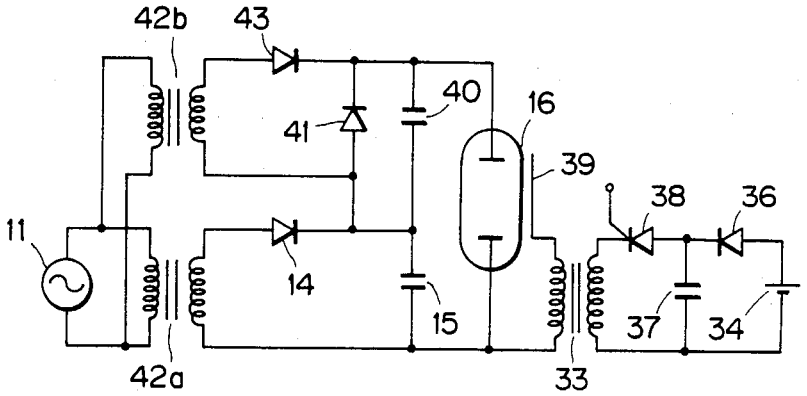

FIG. 16 shows another modification to the fourth embodiment, which employs separate step-up transformers 42*a* and 2*b* for charging the discharge capacitor 15 and the auxiliary capacitor 40. The rest of the circuitry is substantially the same as in FIG. 15. Therefore, similar or comparable effects are obtained with this modification.

Figure 17:
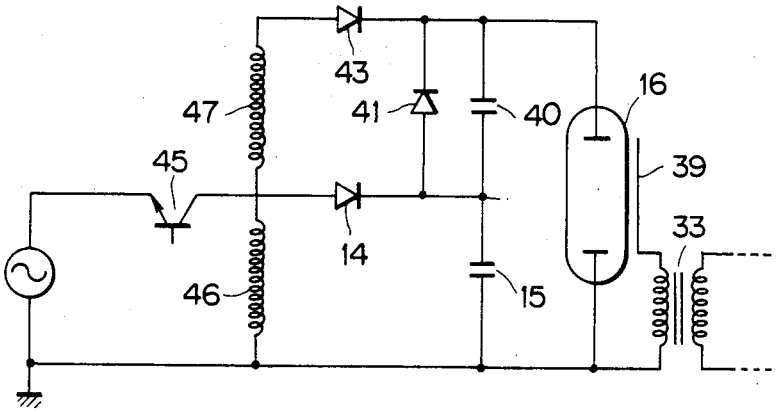

FIG. 17 shows a further modification to the fourth embodiment of FIG. 13, in which a choke coil is employed as a replacement for the step-up transformer in the embodiment of FIG. 13. The choke coil comprises a primary winding 46 and an auxiliary winding 47. The primary winding 46 of the choke coil is connected to a commercial power source 11 via a switching element 45 which comprises a switching transistor, for example.

The auxiliary winding 47 of the choke coil is connected in series to the primary winding 46.

The discharge capacitor 15 is connected to the primary winding 46 of the choke coil through the rectifier 14. On the other hand, the auxiliary capacitor 40 is connected to the auxiliary winding 47 of the choke coil via the rectifier 43. As in the fourth embodiment of FIG. 13, an auxiliary rectifier 41 is connected to the auxiliary winding 47 of the choke coil in parallel with the auxiliary capacitor 40.

It should be appreciated that the choke coil serves to build up electricalal energy while the alternating current from the commercial power source is in its positive phase and transmit the accumulated energy to the corresponding capacitors 15 and 40 by reverse electromotive induction after the negative-going zero-crossing of the alternating current. For instance, during the periods $t_1$ to $t_2$, $t_3$ to $t_4$, $t_5$ to $t_6$ and $t_7$ to $t_8$, electrical energy is accumulated in the primary and auxiliary windings 46 and 47 of the choke coil, as shown in FIG. 6.

Figure 18:
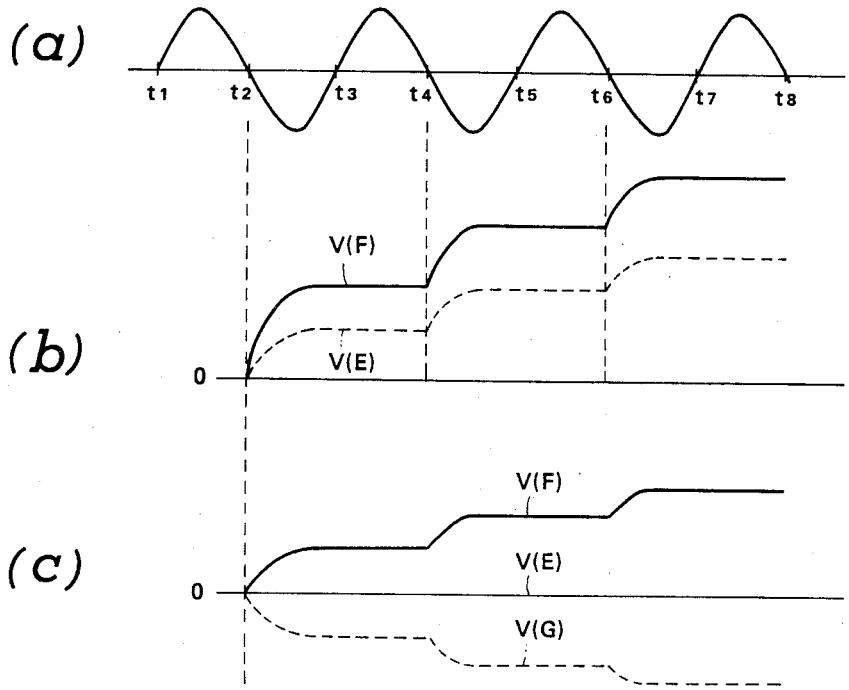
FIG. 18 is a timing chart illustrating the charge and discharge operations of the power supply circuit of FIG. 17.

As mentioned with respect to the first embodiment, the magnitude of the electrical energy is determined by the inductance L and the current flowing through the primary winding 46 according to the equation (1). The accumulated energy is distributed to the discharge capacitor 15 and the auxiliary capacitor 40 to charge both, as shown in FIG. 18(*b*).

Figure 19:
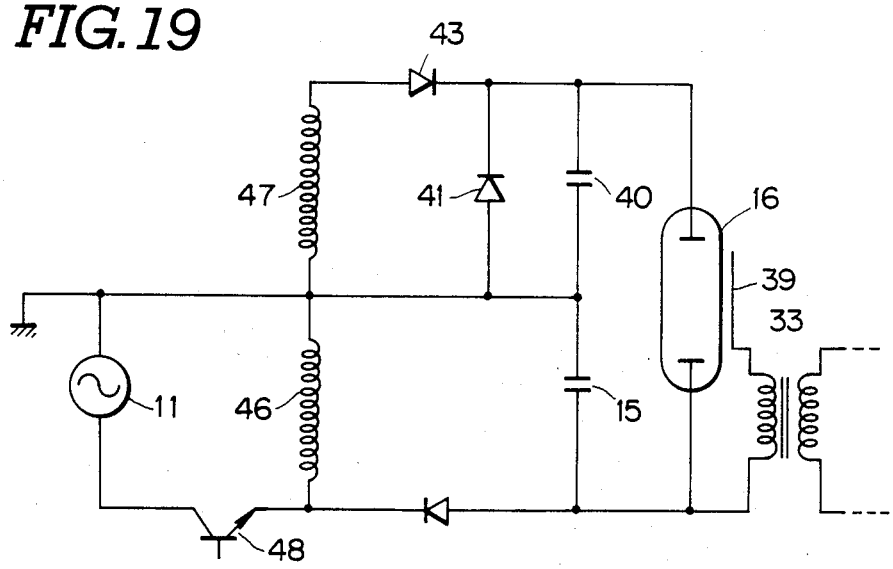
FIG. 19 is a schematic circuit diagram of a further modification to the power supply circuit of FIG. 17.

FIG. 19 shows a modification to the circuit shown in FIG. 17. In this embodiment, junction E, between the discharge capacitor 15 and the auxiliary capacitor 40 is grounded. By grounding the junction E the voltage between ground and the points F and G become as illustrated in FIG. 18(*c*). This lowers the severity of the shock received when someone touches the circuit.

Figure 20:
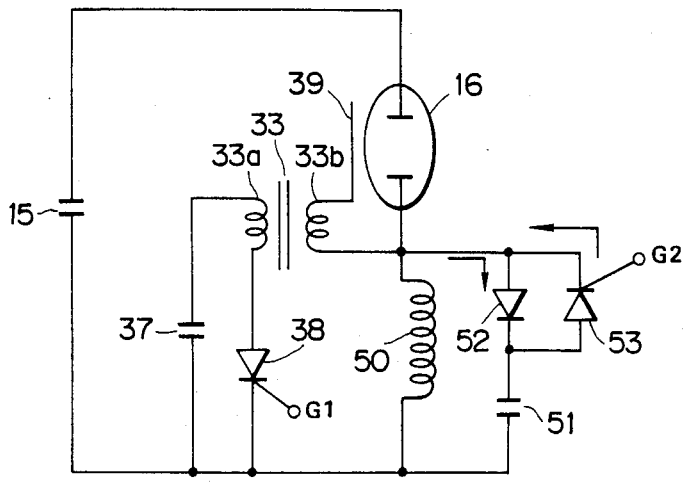
FIG. 20 is a schematic circuit diagram of the fifth embodiment of a power supply circuit for a discharge lamp according to the present invention.

FIG. 20 shows the fifth embodiment of the power supply circuit for the discharge lamp 16, such as a xenon lamp, according to the invention. This embodiment is designed to generate a constant flux of light as the discharge lamp discharges.

It should be appreciated that the discharge capacitor 15 is connected to the charge circuit as in the first to fourth embodiments. Any of the charge circuits of the first to fourth embodiments and their modifications would be applicable to this embodiment.

In this embodiment, the discharge capacitor 15, the discharge lamp 16 and an inductor 50 are connected in series. The trigger thyristor 38 is connected to a trigger gate $G_1$ to receive therethrough a trigger pulse. The trigger thyristor 38 is responsive to the trigger pulse from the trigger gate $G_1$ to become conductive and so establish electrical communication between the trigger capacitor 37 and the primary winding 33*a* of the trigger transformer 33. Therefore, the charge on the trigger capacitor 37 is supplied to the primary winding 33*a* of the trigger transformer 33. As a result, a high voltage is induced in the secondary winding 33*b* of the trigger transformer 33. This high voltage is applied to the trigger electrode 39. In response to this, the charge on the discharge capacitor 15 is applied to the discharge lamp 16 as a discharge current.

On the other hand, a commutating capacitor 51 and a commutating thyristor 52 are connected in parallel to the inductor 50. The commutating thyristor 53 and the commutating capacitor 51 are mutually connected in series. The commutating thyristor 53 receives a commutation signal through a commutating gate $G_2$. While discharge current is being applied to the discharge lamp 16 and the commutating thyristor 53 is held non-conductive due to the absence of the commutation signal, part of the discharge current flows through the rectifier 52 and the commutating capacitor 51 to charge the commutating capacitor, as illustrated by arrow A in FIG. 20. On the other hand, in response to the commutation signal from the commutating gate $G_2$, the commutating thyristor 53 becomes conductive and so the commutating capacitor 51 discharges through the path represented by the arrow B.

Assume that the commutating thyristor 53 remains non-conductive, the discharge capacitor 15 is charged to a level sufficient to cause discharge of the discharge lamp 16, and the trigger thyristor 38 is triggered by the trigger pulse through the trigger gate $G_1$. The charge on the trigger capacitor 37 is then applied to the primary winding 33*a* of the trigger transformer 33 to induce a high voltage in the secondary winding 33*b*. As a result, high voltage is applied to the trigger electrode 39, which starts the discharge lamp 16 discharging. At the same time, part of the discharge current is distributed through the rectifier 52 to the commutating capacitor 51 to charge the latter, as shown in arrow A of FIG. 20.

The commutating signal is applied to the commutating gate $G_2$ when the integral of the light flux emitted by the discharge lamp 16 reaches a predetermined value. The timing of the commutation signal can be determined by means of a light receiver circuit such as is disclosed in "TOSHIBA SEMICONDUCTOR DATABOOK", page 804 (thyristor of rectifying element). The contents of the reference are hereby incorporated by reference for the sake of disclosure.

Figure 21:
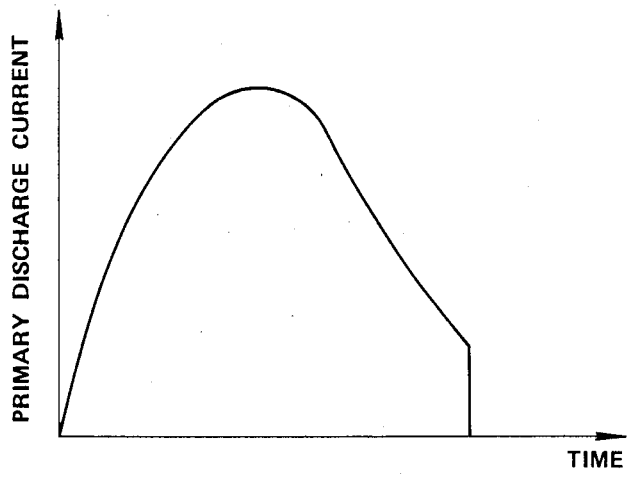
FIG. 21 is a graph of the discharge current versus time in the power supply circuit of FIG. 21.

In response to the commutation signal, the commutating thyristor 53 becomes conductive to allow discharge of the commutating capacitor 51 through the path B. This discharged potential is applied to the cathode electrode of the discharge lamp 16. As a result, the discharge current from the discharge capacitor 15 is blocked. Specifically, the commutating current from the commutating capacitor 51 flows through the commutating thyristor 53 and the inductor 50. Thus, the voltage across the inductor 50 drops in response to the commutating current. Thereby, the inductor 50 serves to block the discharge current. Immediately there after, the discharge current is cut, as shown in FIG. 21.

In this circuit, the discharge lamp 16 can be turned off when the light output reaches the predetermined value. Therefore, excessive light emission by the discharge lamp 16 can be successfully prevented.

Figure 22:
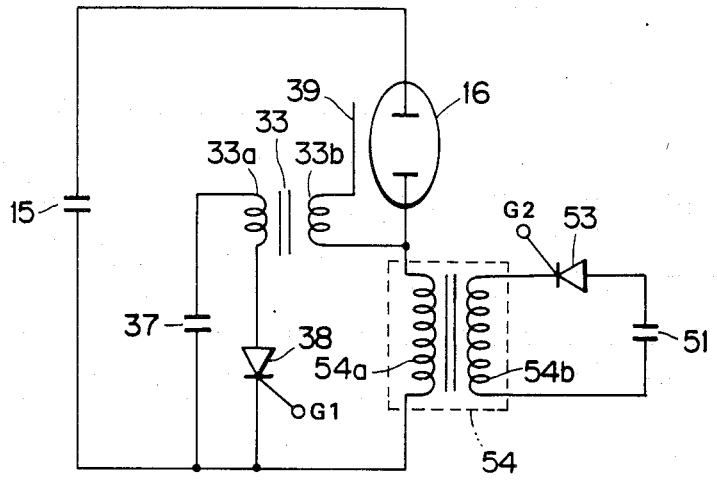
FIGS. 22 and 23 are schematic circuit diagrams of modifications to the fifth embodiment of the power supply circuit of FIG. 20.

FIG. 22 shows a modification to the fifth embodiment of FIG. 20. In this modification, a commutating transformer 54 is used to turn off the discharge lamp 16. The primary winding 54*a* of the commutating transformer 54 is connected in series to the discharge lamp 16. On the other hand, the secondary winding 54*b* of the commutating transformer 54 forms a part of a commutating circuit made up of the commutating thyristor 53 and the commutating capacitor 51.

In this arrangement, the current flowing through the primary winding 54*a* of the commutating transformer as the discharge current flows to the discharge lamp 16 includes mutual induction so that an induced current flows through the commutating circuit and charges the commutating capacitor 51. When the light output reaches the predetermined integrated value, the commutation signal is applied to the commutating thyristor 53 through the commutating gate $G_2$ in a manner substantially the same as in the fifth embodiment of FIG.

20. This causes the commutating capacitor 51 to discharge through the secondary winding 54*b* of the commutating transformer 54. This causes induction in the reverse direction, i.e. opposite the direction of the discharge current. Therefore, the primary coil 54*a* of the commutating transformer 54 blocks the discharge current.

Figure 23:
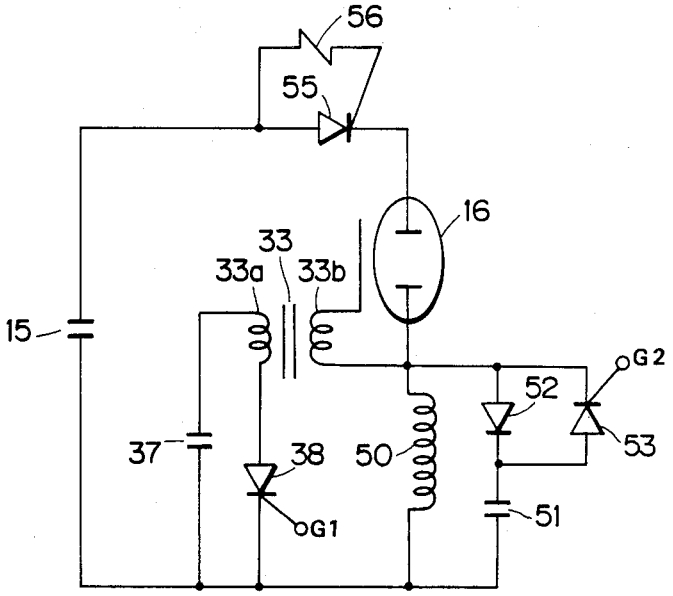
Figure 24:
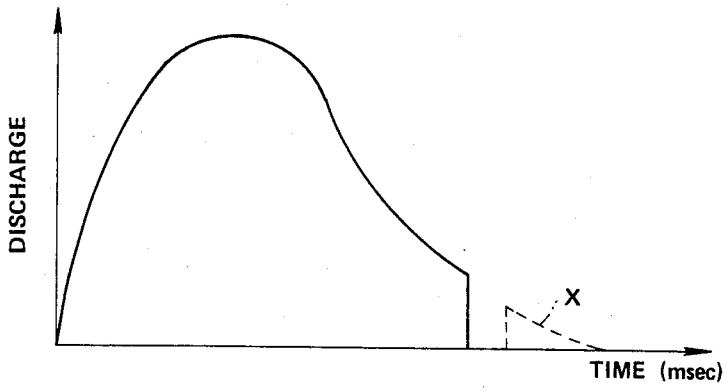
FIG. 24 is a graph of the discharge current in the power supply circuit of FIG. 23.

FIG. 23 shows another modification to the fifth embodiment. As will be appreciated from FIG. 23, the circuit employs a thyristor 55 and voltage regulating element 56. The thyristor 55 is connected in series between the discharge capacitor 15 and the discharge lamp 16. On the other hand, the voltage regulator element 56 is connected in parallel to the thyristor 55 and is connected to the anode of the thyristor. The thyristor 55 and the voltage regulator element 56 prevent the discharge lamp 16 from re-discharging immediately after the discharge current is cut off. Specifically, the thyristor 55 and the voltage regulator element 56 cooperate to prevent the discharge lamp 16 from being re-discharged by the current X shown in FIG. 24. The current X is the discharge current resulting from the residual charge on the discharge capacitor 15 following exhaustion of the charge on the commutating capacitor 51.

Figure 25:
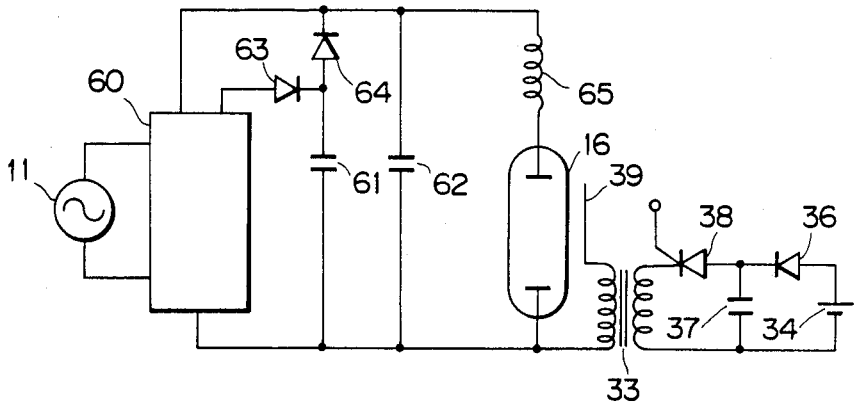
FIG. 25 is a schematic circuit diagram of the sixth embodiment of a power supply circuit for a discharge lamp according to the present invention.

FIG. 25 shows the sixth embodiment of the power supply circuit for the discharge current according to the invention, which is especially well suited for flash fixation in dry-type xerographic copiers, facsimile or facsimile telegraphs, printers and so forth. In particular, this embodiment can be used to good advantageous in flash-fixation of toner images.

According to the sixth embodiment, as in the fourth embodiment of FIG. 13, a discharge capacitor 61 and an auxiliary capacitor 62 are employed. The discharge capacitor 61 has a relatively high capacitance and the auxiliary capacitor 62 has a relatively low capacitance. The discharge capacitor 61 is charged by a charge current from a charging source 60 which comprises a step-up transformer, a choke coil or the like and which is connected to the commercial power source 11. The auxiliary capacitor 62 is connected in parallel to the discharge capacitor 61.

The auxiliary capacitor 62 is charged by current from the charging source 60. On the other hand, the discharge capacitor 61 is charged by current flowing via a rectifier 63 from the charging source 60. The voltage $V_1$ of the charge current to the auxiliary capacitor 62 is higher than the voltage $V_2$ applied to the discharge capacitor 61. The charge currents charge the auxiliary and discharge capacitors 62 and 61 to the voltage $V_1$ and $V_2$, respectively.

Figure 27:
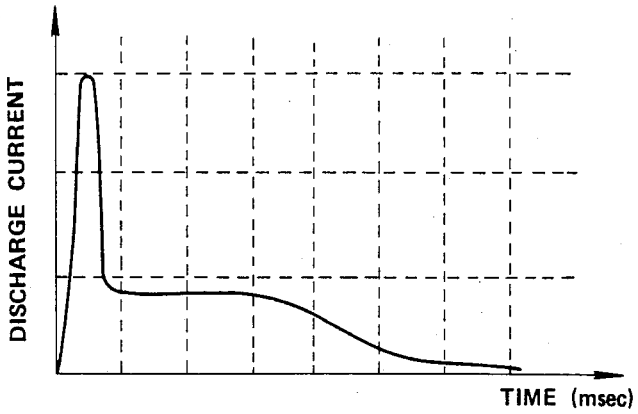
FIGS. 27 and 28 are graphs of the discharge characteristics of the power supply circuits of FIGS. 25 and 26, respectively.

After both of the discharge capacitor 61 and the auxiliary capacitor 62 have been charged, the trigger pulse is applied to the trigger gate $G_1$ to make the trigger thyristor 38 conductive. This induces a high voltage in the secondary winding of the trigger transformer 33. The high voltage is applied to the trigger electrode 39 to trigger discharge the auxiliary capacitor 62 through the discharge lamp 16. At this time, the discharge from the auxiliary capacitor 62 flows through a choke coil 65, and the discharge lamp 16 and back to the auxiliary capacitor 62. The waveform of the discharge current from the auxiliary capacitor 62 is determined by the capacitance of the auxiliary capacitor, the inductance of the choke coil 65 and impedance of the discharge lamp 16, which specify a discharge time constant. By selecting those parameters, i.e. the capacitance of the auxiliary capacitor 62, the inductance of the choke coil 65 and the impedance of the discharge lamp 16, a relatively large current can be generated in a relatively short period, as shown in the period 0 to 1 msec. of FIG. 27. During this period, the intensity of the discharge lamp 16 reaches a significantly intense peak.

It should be appreciated that the surge-preventive diode 64 prevents the current from the auxiliary capacitor 62 from flowing to the discharge capacitor 61.

After the aforementioned initial intense flash period, i.e. 0 to 1 msec., the current value of the discharge current from the auxiliary capacitor 62 drops to equality with the charge on the discharge capacitor 61. Then, the discharge capacitor 61 starts discharging. At this time, the discharge current flows from the auxiliary capacitor 62, through the choke coil 65 and to the discharge lamp 16 and from the discharge capacitor 61 through the choke coil 65 to the discharge lamp 16. In this case, due to the relatively low voltage discharge from the discharge capacitor, a smaller current flows for a longer period, i.e. between the times 1 msec. to 7 msec. of FIG. 27. During this period, due to the low discharge current, a relatively weak flash is output.

The effects of various kinds of discharge of the discharge lamp will be discussed in order to facilitate full understanding of the advantages of the aforementioned sixth embodiment. Conventionally, it is believed that, given fixed discharge energy, better toner fixation is achieved with a shorter discharge period (pulse width), while, on the other hand, too short a discharge period will cause scattering of the toner and thus degrade the fixed image. When the discharge period is too short, the pulse noise during energization of the discharge lamp is also increased and the toner can be atomized by the abrupt heating, resulting in a bad smell. Therefore, it is conventionally believed that a discharge period in a range of 0.5 msec. to 2.5 msec. is best. However, this approach has not been successful, since toner scattering still tends to degrade the reproduced image.

In another approach, it has been found that high-quality fixation can be achieved by increasing the discharge energy and prolonging the discharge period. This prevents scattering of toner successfully. However, this method is applicable only to high-contrast images. For paler images, high discharge energy and long discharge period serve only to degrade fixation quality.

In the preferred procedure, overall discharge period consists of an initial, intense flash component and a subsequent, weak flash component. This obviates the defects of the conventional processes. This process will be described in greater detail with reference to FIG. 27. In the preferred process, immediately after triggering the discharge lamp, a very large current is applied to the discharge lamp to energize the discharge lamp 16 intensely. An intense flash is achieved within about 1 msec. after triggering. The current level within this period is selected so as not to cause scattering of the toner image even if the toner concentration is high. During this period, a good high-quality fixation of the toner image can be obtained even with a relatively low concentration of toner. Subsequently, for the period 1 msec. to 7 msec. after triggering, a relatively weak current, e.g. about $\frac{1}{3}$ of the peak current value, is applied to the discharge lamp 16 to cause relatively weak but prolonged discharge of the discharge lamp 16. During this period, a high-quality high-toner-concentration image can be fixed.

Figure 26:
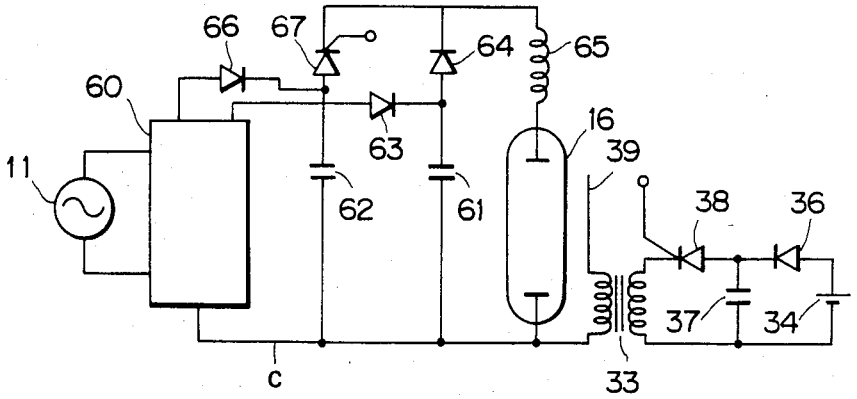
FIG. 26 is a schematic circuit diagram of a modification to the power supply circuit of FIG. 25.
Figure 28:
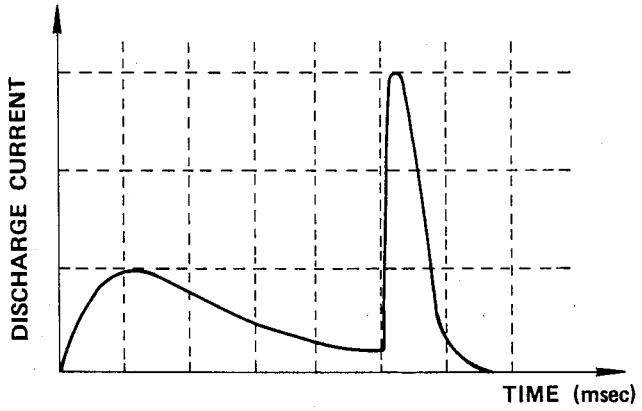

Effects comparable to those of the preferred process can be achieved by performing an intense, brief flash at some timing other than that disclosed above. An example is shown in FIG. 28. A circuit capable of performing the process of FIG. 28 is illustrated in FIG. 26. In the process of FIG. 28, an intense flash occurs during the period 5 msec. to 6 msec. after triggering the discharge lamp.

In the modified circuit of FIG. 26, a diode 66 is interposed between the charging circuit 60 and the auxiliary capacitor 62 and a thyristor 67 is interposed between the capacitor 62 and the choke coil 65. A timing gate $G_3$ of the thyristor 67 is connected to an appropriate timing circuit which generates a timing signal which controls the thyristor. In the shown embodiment, the timing circuit outputs a timing signal 5 msec. after the discharge lamp 16 is triggered.

Therefore, when the trigger pulse turn ON the trigger thyristor 38 and so induces a high voltage in the trigger electrode 39, at first, the thyristor 67 remains OFF. As a result, the discharge capacitor 61 starts discharging before the auxiliary capacitor 62 starts discharging. The current from the discharge capacitor 61 flows through the diode 64, the choke coil 65 and the discharge lamp 16. The discharge time constant of the discharge capacitor 61 is relatively large so that current through the discharge lamp decreases slowly after it reaches its peak value. After 5 msec., the timing signal is applied to the timing gate $G_3$ of the thyristor 67 to turn the latter ON. In response to turning ON of the thyristor 67, the auxiliary capacitor 62 start discharging. Then, the current flows through the thyristor 67, the choke coil 65 and the discharge lamp 16. Since the discharge time constant of the auxiliary capacitor 62 is relatively small, the charge on the auxiliary capacitor is exhausted within about 1 msec. Therefore, the circuit of FIG. 26 exhibits the discharge characteristics illustrated in FIG. 28.

In the preferred form of the circuits of FIGS. 25 and 26, the discharge capacitor 61 and the auxiliary capacitor 62 will have capacitances of 125 μF and 825 pF, respectively. The voltages applied to the capacitors 61 and 62 as charge voltages are 3600 V and 1800 V respectively. The discharge lamp 16 is a xenon lamp with an electrode gap of 1000 mm, an internal diameter of 11 mm and a xenon gas pressure of 210 Tor.

Figure 29:
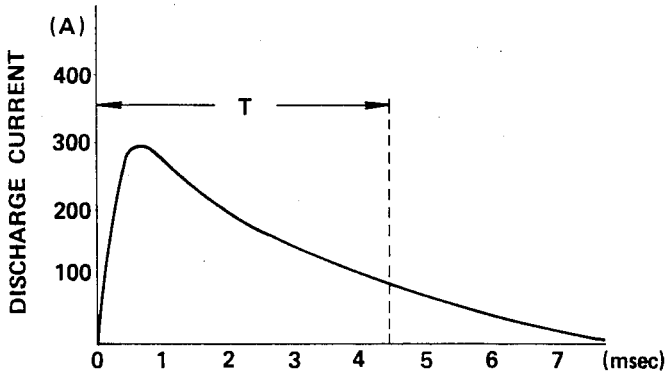
FIGS. 29 and 30 are graphs of the discharge characteristics of the power supply circuits of FIGS. 5 and 13, respectively.
Figure 30:
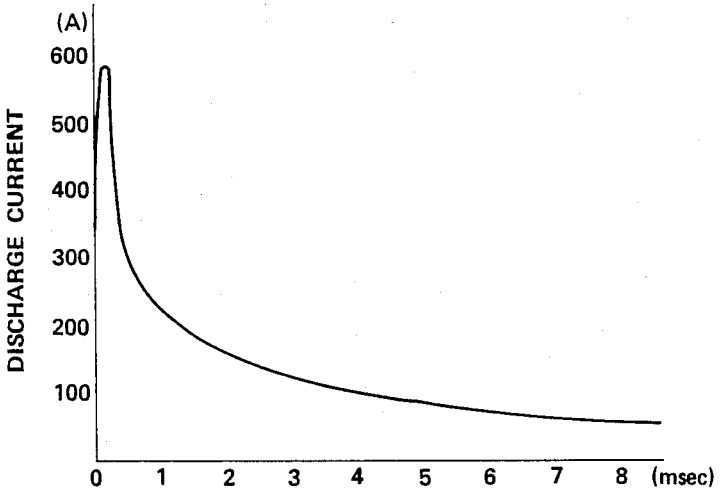

This is another approach to high quality fixation, the preferred characteristics of which are illustrated in FIGS. 29 and 30. In order to achieve the characteristics of FIG. 29, a circuit equivalent to FIG. 5 is used. In the preferred arrangement, the capacitance of the discharge capacitor 15 is selected to be 1100 μF. The discharge lamp 16 is a xenon lamp with a 1000-mm electrode gap, an 11-mm diameter and a 210-Tor xenon gas pressure. In addition, a choke coil of 350 μH is inserted between the discharge capacitor and the discharge lamp 16.

The discharge capacitor 15 is charged at a voltage of 1600 V. By applying a trigger pulse at an appropriate timing, the discharge characteristics of FIG. 29 can be obtained.

Alternatively, the preferred process for fixing the tonor image according to this embodiment can be performed by a circuit substantially the same as the circuit illustrated in FIG. 13. In order to perform the preferred process, the xenon lamp with a 1000-mm electrode gap, an 11-mm internal diameter and a 210-Tor xenon gas pressure, is used as the discharge lamp 16. The discharge capacitor 15 has a capacitance of 825 μF and the auxiliary capacitor 40 has a capacitance of 125 μF. As above, a 350 μH choke coil is connected between the capacitors 15 and 40 and the discharge lamp 16. The charge voltage of both the discharge capacitor 15 and the auxiliary capacitor 40 is set to 1800 V. Since the discharge capacitor 15 is connected to the auxiliary capacitor 40 in series, the potential at the point F will be 3600 V and the potential at the point E will be 1800 V.

Therefore, the discharge characteristics of this circuit are as illustrated in FIG. 30.

Figure 31:
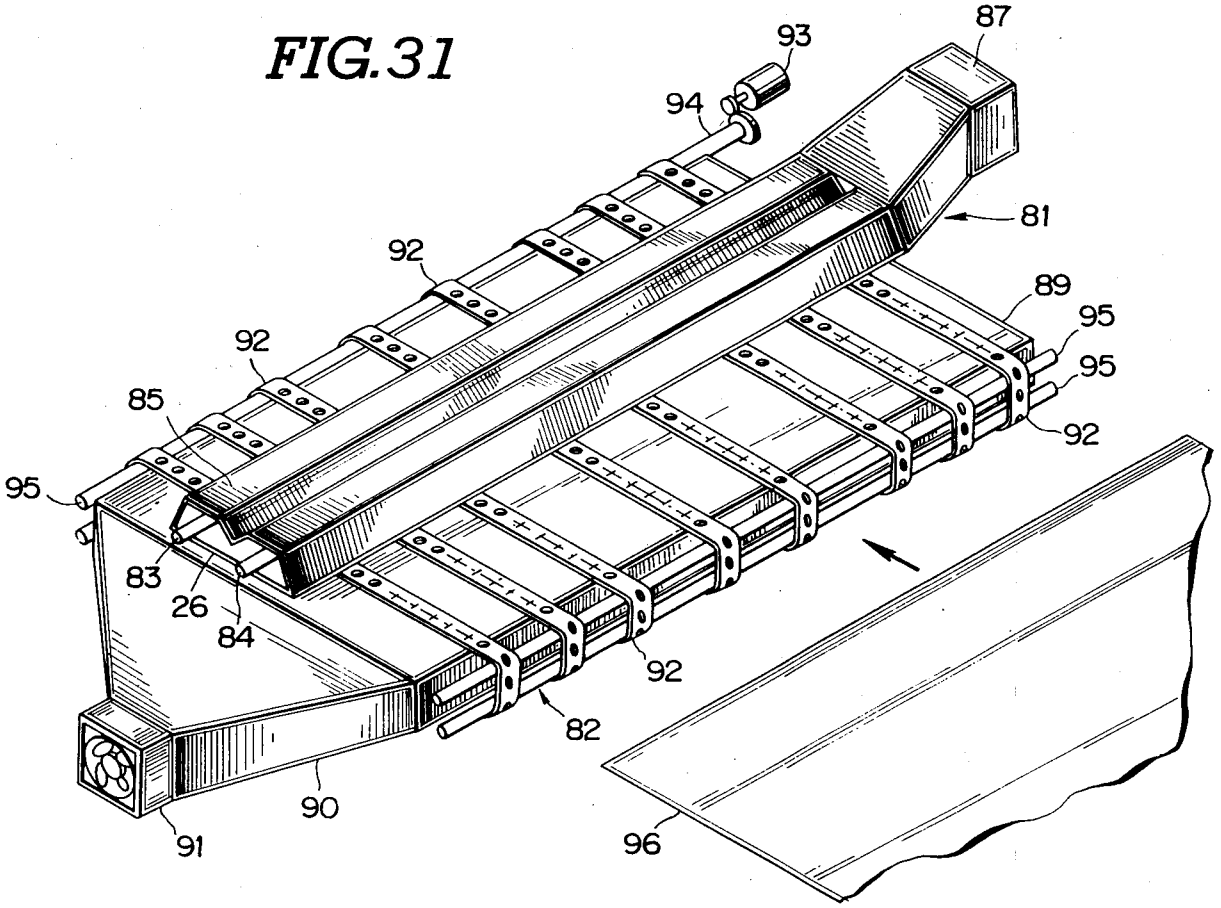
FIG. 31 is a perspective view of a flash fixation device according to the preferred embodiment of the invention.

FIG. 31 shows a flash fixation device performing the fixation process according to the characteristics of FIG. 29 or FIG. 30. A flash section 81 comprises a pair of xenon lamps 83 and 84. A path for blank copy paper 96 is defined beneath the flash section 81. The path includes a conveyor section 82 on which the copy paper is conveyed across the flash section 81.

The flash section 81 further comprises a reflector plate 85 and a transparent dust cover 86. The reflector plate 85 and the transparent dust cover 86 define an internal space through which the xenon lamps 83 and 84 extend. The transparent dust cover may be made of glass. A cooling fan 87 in the internal space defined by the reflector plate 85 and the transparent dust cover supplies ventilation to cool the lamps 83 and 84.

The conveyor section 82 comprises a cross-sectionally rectangular base 89 which defines an internal space. A rectangular tapered section 90 is formed intergrally with or connected to one end of the base 89. A fan 91 is installed at the outer end of the tapered section 90 for ventilation through the internal space of the base 89. A plurality of conveyor belts 92, each of which has a number of longitudinally aligned through openings, are wound around the base 89. The conveyor belts 92 are stretched around idler shafts 95 and a drive shaft 94. The drive shaft 94 is connected to a driving motor 93 to be driven by the latter. The conveyor belts 92 are driven by the driving shaft 94 so as to feed the copy paper across the working face of the flash section 91.

The part of the base 89 opposing the flash section 81 has a plurality of through openings or slits. These opening of slits are intended to allow external air flow due to the fan 91 into the internal space of the base 89. This helps hold the copy paper onto the conveyor belts 92.

The xenon lamps 83 and 84 are triggered to flash when the copy paper passes beneath the flash section. The discharged flash energy melts the toner and so fixes a toner image on the copy paper.

In the shown arrangement, each of the xenon lamps 83 and 84 has an 1000-mm electrode gap, an 11-mm internal diameter and a 210-Tor xenon gas pressure, as in the other embodiments. The width of the transparent dust cover in the conveying direction is 90 mm and the distance from the transparent cover surface to the opposing surface of the copy paper is 10 mm.

Under these conditions, experimental fixation of a linear image and a solid image (all-black image) of 1.6 MacBeth density was performed. The results of these experimets are is illustrated in FIGS. 32(*a*) to 32(*d*).

Figure 32:
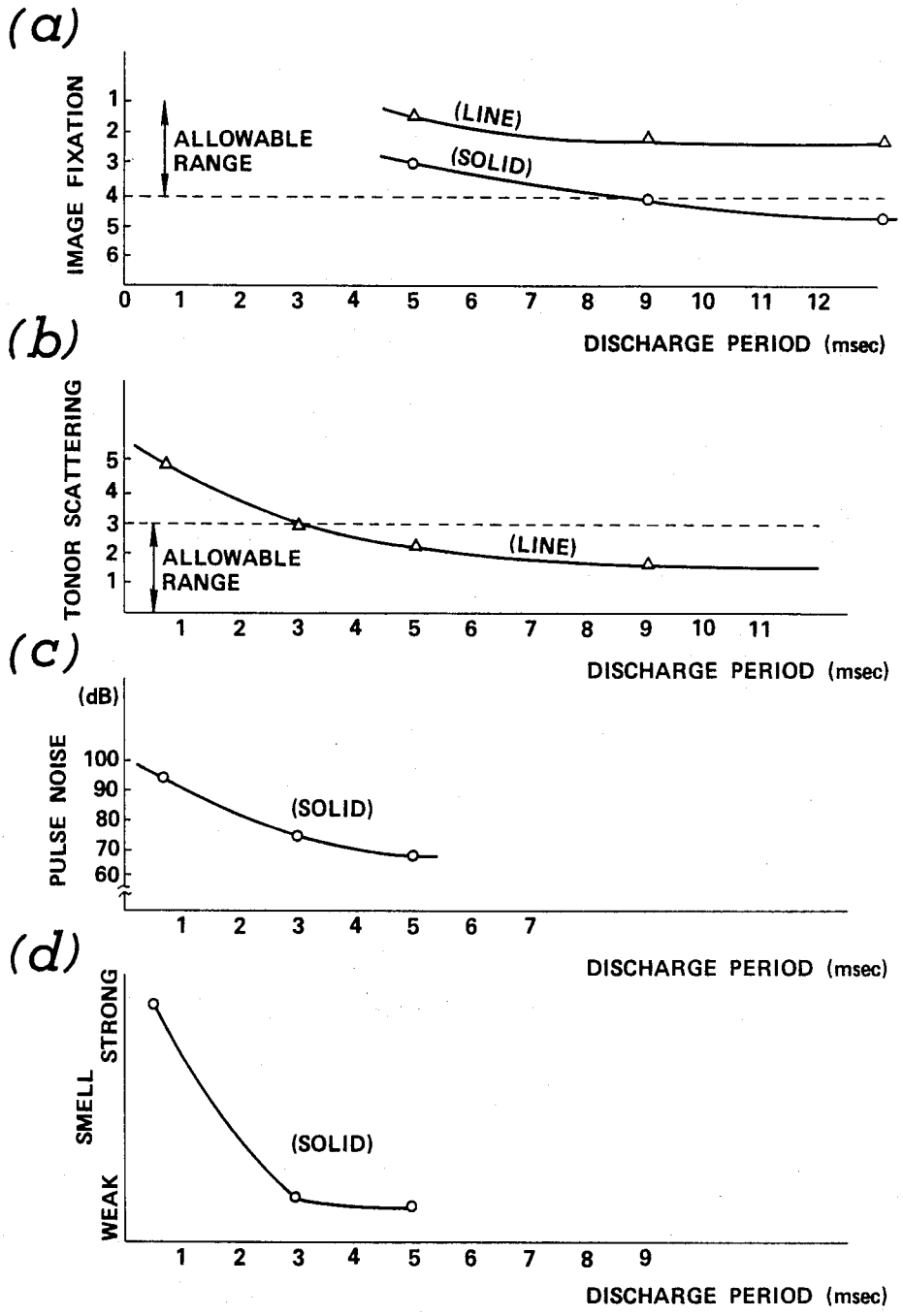
FIGS. 32(*a*) to 32(*d*) are graphs of the results of experiments performed on the device of FIG. 31.

In FIGS. 32(*a*) to 32(*d*), (a) shows fixation, (b) shows scattering characteristics, (c) shows amplitude of pulse noise, and (d) shows smell. Triangular points represent data measured for the linear image and circles represent solid image data.

As will be appreciated from FIG. 32(*a*), for the line image, acceptable fixation can be achieved even when the discharge period (pulse width) is greater than 13 msec. However, for the solid image, acceptable fixation could be obtained with discharge periods equal to or less than 9 msec.

An acceptable degree of scattering obtains at discharge periods equal to or longer than 3 msec. Tests for pulse noise and smell were conducted only for the solid image. As shown in FIGS. 32(*c*) and 32(*d*), when the discharge period is equal to or longer than 3 msec., both of the noise level and the smell level are acceptable.

Therefore, by setting the discharge period of the discharge lamp, i.e. the xenon lamp, to within the range of 3 msec. to 9 msec., good fixation characteristics can be obtained.

The preferred embodiments successfully fulfill all of the objects and advantages sought for the invention.

While the present invention has been disclosed in terms of the preferred embodiments of the invention to facilitate better understanding, the invention can be employed in many ways without departing from the principles of the invention set out in the appended claims. Therefore, the invention should be appreciated to include all possible embodiments and modifcations to the shown embodiments which do not depart from the principles of the invention.

What is claimed is:

1. A power supply circuit for a discharge lamp comprising:

a primary charge current supply means for accumulating energy; said primary charge current supply means including an alternating current source, accumulates energy while the alternating current is a first phase and supplies said accumulated energy to said primary discharge capacitor while the alternating current is a second, opposite phase and a switching means responsive to zero-crossing of said alternating current to control accumulation and supply of energy;

a single primary discharge capacitor associated with said charge current supply means to receive said accumulated energy at a given timing to be charged, said discharge capacitor supplying power to said discharge lamp to cause emission of light upon discharging; and a trigger means, associated with said discharge lamp, for triggering energization of said discharge lamp and discharge of said discharge capacitor and therby causing emission of light by said discharge lamp.

2. The power supply circuit as set forth in claim 1, which is associated with a secondary circuit including a secondary charge current supply means for accumulating energy and a secondary discharge capacitor connected in series to said primary discharge capacitor, said secondary discharge capacitor being associated with said secondry charge current supply means to be charged at a given timing with the energy accumulated by said secondary charge current supply means.

3. The power supply circuit as set forth in claim 2, wherein said secondary charge current supply means includes an alternating current source, accumulates energy while the alternating current is a first phase and supplies said accumulated energy to said secondary discharge capacitor while the alternating current is a second, opposite phase.

4. A power supply circuit for a discharge lamp comprising:

a primary charge current supply means for accumulating energy;

a single primary discharge capacitor associated with said charge current supply means to receive said accumulated energy at a given timing to be charged, said discharge capacitor supplying power to said discharge lamp to cause emission of light upon discharging;

a second auxiliary capacitor of lower capacitance than said first primary capacitor, said second auxiliary capacitor being associated with said charge current supply means to be commonly charged with said first primary capacitor, and the potential of said second auxiliary capacitor being sufficiently high to energize said discharge lamp; and a trigger means, associated with said discharge lamp, for triggering energization of said discharge lamp and discharge of said discharge capacitor and thereby causing emission of light by said discharge lamp.

5. The power supply circuit as set forth in claim 4, wherein said first primary and second auxiliary capacitor are charged by said charge current supply means at different voltages.

6. The power supply circuit as set forth in claim 5, wherein said charge current supply means comprises a flyback transformer.

7. The power supply circuit as set forth in claim 4, said charge current supply means comprises a first component associated with said first primary capacitor for charging the latter and a second component associated with said second auxiliary capacitor for charging the latter, and said first and second components of said charge current supply means operating independently of each other.

8. The power supply circuit as set forth in claim 7, wherein each of said first and second components comprises a flyback transformer.

9. The power supply circuit as set forth in claim 1, wherein further comprises means for blocking power supply to said discharge lamp, said blocking means becoming active at a given timing.

10. The power supply circuit as set forth in claim 9, wherein said blocking means is responsive to a timing signal generated when the time integral of the light flux emitted by said discharge lamp reaches a predetermined value.

11. The power supply circuit as set forth in claim 10, wherein said blocking means comprises a capacitor charged by part of the power supplied to said discharge lamp and which discharges in response to said timing signal.

12. The power supply circuit as set forth in claim 1, which further comprises a second auxiliary capacitor having a lower capacitance and a higher charge voltage than said first primary capacitance, said first primary and second auxiliary capacitors being discharged at different known times.

13. The power supply circuit as set forth in claim 12, wherein said second auxiliary capacitor discharges prior to said said first primary capacitor, thereby inducing brief, intense light emission by said discharge lamp, and subsequently inducing a weaker, longer emission by means of discharging said first primary capacitor.

14. The power supply circuit as set forth in claim 12, wherein said first primary capacitor discharges prior to said second auxiliary capacitor, thereby inducing a weak, prolonged light emission by said discharge lamp and subsequently inducing an intense, brief emission by means of discharging said second auxiliary capacitor.

15. The power supply circuit as set forth in claim 1, wherein discharge period of said discharge lamp is in the range of 3 msec. to 9 msec.

16. A charge/discharge circuit for a discharge lamp comprising:

a charge current supply means supplying current at a known voltage for capacitor charging:

a primary discharge capacitor associated with said charge current supply means to receive said current at a given timing and connected to said discharge lamp to supply power thereto so as to energize light emission thereby; and a secondary discharge capacitor associated with said current supply means to receive current at a given timing and connected to said discharge lamp to supply power thereto, said secondary discharge capacitor having a lower capacitance and a higher potential than said primary discharge capacitor, which potential being sufficiently high to energize said discharge lamp; and a trigger means, associated with said discharge lamp, for triggering said discharge lamp and triggering discharge of said discharge capacitor and thereby triggering light emission by said discharge lamp.

17. The charge/discharge circuit as set forth in claim 16, wherein said first primary and second auxiliary capacitors are charged by said current supply means at different voltages.

18. The charge/discharge circuit as set forth in claim 17, wherein said current supply means comprises a flyback transformer.

19. The charge/discharge circuit as set forth in claim 16, said current supply means comprises a first component associated with said first primary capacitor for charging the latter and a second component associated with said second auxiliary capacitor for charging the latter, and said first and second components of said current supply means operating independently of each other.

20. The charge/discharge circuit as set forth in claim 19, wherein each of said first and second components comprises a flyback transformer.

21. The charge/discharge circuit as set forth in claim 16, wherein further comprises means for blocking power supply to said discharge lamp, said blocking means becoming active at a given timing.

22. The charge/discharge circuit as set forth in claim 21, wherein said blocking means is responsive to a timing signal generated when the time integral of the light flux emitted by said discharge lamp reaches a predetermined value.

23. The charge/discharge circuit as set forth in claim 22, wherein said blocking means comprises a capacitor charged by part of the power supplied to said discharge lamp and which discharges in response to said timing signal.

24. The charge/discharge circuit as set forth in claim 16, wherein said primary and auxiliary capacitors are discharged at different known times.

25. The charge/discharge circuit as set forth in claim 24, wherein said auxiliary capacitor discharges prior to said primary capacitor, thereby inducing brief, intense light emission by said discharge lamp, and subsequently inducing a weaker, longer emission by means of discharging said primary capacitor.

26. The charge/discharge circuit as set forth in claim 24, wherein said primary capacitor discharges prior to said auxiliary capacitor, thereby inducing a weak, prolonged light emission by said discharge lamp and subsequently inducing an intense, brief emission by means of discharging said auxiliary capacitor.

27. The power supply circuit as set forth in claim 16, wherein discharge period of said discharge lamp is in the range of 3 msec. to 9 msec.

* * * * *